US007425203B2

(12) United States Patent
Van Brunt et al.

(10) Patent No.: US 7,425,203 B2
(45) Date of Patent: Sep. 16, 2008

(54) OSCILLATORY CHEST WALL COMPRESSION DEVICE WITH IMPROVED AIR PULSE GENERATOR WITH IMPROVED USER INTERFACE

(75) Inventors: Nicholas P. Van Brunt, White Bear Lake, MN (US); Eric L. Stechmann, Shoreview, MN (US)

(73) Assignee: Hill-Rom Services, Inc., Wilmington, DE (US)

( * ) Notice: Subject to any disclaimer, the term of this patent is extended or adjusted under 35 U.S.C. 154(b) by 149 days.

(21) Appl. No.: 10/295,782

(22) Filed: Nov. 15, 2002

(65) Prior Publication Data

US 2004/0097842 A1 May 20, 2004

(51) Int. Cl.
*A61H 31/00* (2006.01)

(52) U.S. Cl. ..... 601/41; 601/DIG. 8; 601/DIG. 11

(58) Field of Classification Search ..... 601/41, 601/44, 148–152; 417/413.1
See application file for complete search history.

(56) References Cited

U.S. PATENT DOCUMENTS

| | | | | |
|---|---|---|---|---|
| 2,762,366 | A | | 9/1956 | Huxley |
| 2,772,673 | A | | 12/1956 | Huxley |
| 2,779,329 | A | | 1/1957 | Huxley |
| 2,780,222 | A | | 2/1957 | Polzin |
| 2,832,335 | A | | 1/1958 | Huxley |
| 3,120,228 | A | | 2/1964 | Huxley |
| 3,333,581 | A | | 8/1967 | Robinson |
| 3,566,862 | A | | 3/1971 | Schuh |
| 3,896,794 | A | | 7/1975 | McGrath |
| 4,079,733 | A | | 3/1978 | Denton |
| 4,398,531 | A | | 8/1983 | Havstad |
| 4,424,806 | A | | 1/1984 | Newman |
| 4,838,263 | A | | 6/1989 | Warwick |
| 4,928,674 | A | * | 5/1990 | Halperin et al. ..... 601/44 |
| 4,971,042 | A | | 11/1990 | Lerman |
| 4,977,889 | A | | 12/1990 | Budd |
| 5,020,516 | A | * | 6/1991 | Biondi et al. ..... 601/44 |
| 5,056,505 | A | | 10/1991 | Warwick |
| 5,453,081 | A | | 9/1995 | Hansen |
| 5,769,797 | A | | 6/1998 | Van Brunt |
| 5,830,164 | A | | 11/1998 | Cone et al. |
| 5,997,488 | A | | 12/1999 | Gelfand |
| 6,030,353 | A | | 2/2000 | Van Brunt |
| 6,036,662 | A | | 3/2000 | Van Brunt |
| 6,066,101 | A | | 5/2000 | Johnson |
| 6,179,793 | B1 | | 1/2001 | Rothman et al. |
| 6,190,337 | B1 | * | 2/2001 | Nedwell ..... 601/46 |
| 6,210,345 | B1 | | 4/2001 | Van Brunt |
| 6,254,556 | B1 | | 7/2001 | Hansen |
| 6,340,025 | B1 | | 1/2002 | Van Brunt |
| D453,560 | S | | 2/2002 | Van Brunt |

(Continued)

FOREIGN PATENT DOCUMENTS

| | | | |
|---|---|---|---|
| WO | WO01/24698 | * | 4/2001 |

(Continued)

*Primary Examiner*—Danton DeMille
(74) *Attorney, Agent, or Firm*—Barnes & Thornburg LLP

(57) ABSTRACT

An improved air pulse generator produces high frequency chest wall oscillations (HFCWO) and has an improved user interface. The user interface allows the patient to select from a plurality of modes, which correspond to stored treatment protocols. Once selected, the air pulse generator performs the protocol corresponding to the selected mode.

16 Claims, 27 Drawing Sheets

U.S. PATENT DOCUMENTS

| | | | | |
|---|---|---|---|---|
| 6,379,316 | B1 | 4/2002 | Van Brunt | |
| 6,415,791 | B1 | 7/2002 | Van Brunt | |
| 6,488,641 | B2 | 12/2002 | Hansen | |
| 6,558,338 | B1 * | 5/2003 | Wasserman | 601/152 |
| 2002/0014235 | A1 | 2/2002 | Rogers et al. | |
| 2002/0111571 | A1 * | 8/2002 | Warwick et al. | 601/44 |

FOREIGN PATENT DOCUMENTS

| | | |
|---|---|---|
| WO | WO 02/06673 | 1/2002 |

* cited by examiner

| Mode | Modifier | Frequency | Pressure | Frequency vs. Time |
|---|---|---|---|---|
| Step | High | 10 - 13 - 16 - 19 | 3 (1 to 4*) | 5 Min 20 |
| | Normal | 8 - 11 - 14 - 17 | 3 (1 to 4*) | |
| | Low | 5 - 8 - 11 - 14 | 3 (1 to 4*) | |
| Sweep | High | 10 - 20 | 3 (1 to 4*) | 20 5 Min |
| | Normal | 7 - 17 | 3 (1 to 4*) | |
| | Low | 5 - 15 | 3 (1 to 4*) | |

*Fig. 4*

Model 104 Software Specifications

| | Default Settings | | | | | Button Functionality | | |
|---|---|---|---|---|---|---|---|---|
| Mode | Pulsing | Default Mode | Frequency | Pressure | Time | UL / LL | UM / LM | UR / LR |
| IDLE (Reset Occurs) | No | Sweep Normal | 7 -17 Hz | 3 | 20 Min | N/A | N/A | N/A |
| | | | | | | | | |
| AUTO READY | No | Sweep Normal | 7 -17 Hz | 3 | 20 Min | N/A | N/A | N/A |
| AUTO RUN | Yes | Sweep Normal | 7 -17 Hz | 3 | 20 Min | Pressure | N/A | N/A |
| AUTO PAUSED | No | Sweep Normal | 7 -17 Hz | 3 or Selected | Time Remaining (Min) | N/A | N/A | N/A |
| | | | | | | | | |
| PROGRAM ADJUST | No | Manual | 12 Hz or Selected | 3 or Selected | 10 Min or Selected | Mode | Manual Adjust | Manual Adjust |
| PROGRAM ADJUST: SWEEP | No | N/A (Sweep) | Normal or Selected | 3 or Selected | 20 Min or Selected | Mode | Frequency | Time |
| PROGRAM ADJUST: STEP | No | N/A (Step) | Normal or Selected | 3 or Selected | 20 Min or Selected | Mode | Frequency | Time |
| | | | | | | | | |
| MANUAL ADJUST | No | N/A (Manual) | 12 Hz or Selected | 3 or Selected | 10 Min or Selected | Frequency | Pressure | Time |
| | | | | | | | | |
| PROGRAM RUN | Yes | Manual | 12 Hz or Selected | 3 or Selected | 10 Min or Selected | Frequency | Pressure | Time |
| PROGRAM RUN: SWEEP | Yes | N/A (Sweep) | Normal or Selected | 3 or Selected | 20 Min or Selected | Pressure | N/A | N/A |
| PROGRAM RUN: STEP | Yes | N/A (Step) | Normal or Selected | 3 or Selected | 20 Min or Selected | Pressure | N/A | N/A |

*Fig. 5*

OSCILLATORY CHEST WALL COMPRESSION DEVICE WITH IMPROVED AIR PULSE GENERATOR WITH IMPROVED USER INTERFACE

BACKGROUND OF THE INVENTION

The present invention relates to chest compression devices and in particular to a high frequency chest wall oscillator device.

Manual percussion techniques of chest physiotherapy have been used for a variety of diseases, such as cystic fibrosis, emphysema, asthma and chronic bronchitis, to remove excess mucus that collects in the lungs. To bypass dependency on a caregiver to provide this therapy, chest compression devices have been developed to produce High Frequency Chest Wall Oscillation (HFCWO), a very successful method of airway clearance.

The device most widely used to produce HFCWO is THE VEST™ airway clearance system by Advanced Respiratory, Inc. (f/k/a American Biosystems, Inc.), the assignee of the present application. A description of the pneumatically driven system is found in the Van Brunt et al. Patent, U.S. Pat. No. 6,036,662, which is assigned to Advanced Respiratory, Inc. Additional information regarding HFCWO and THE VEST™ system is found on the Internet at www.thevest.com. Other pneumatic chest compression devices have been described by Warwick in U.S. Pat. No. 4,838,263 and by Hansen in U.S. Pat. Nos. 5,543,081 and 6,254,556 and Int. Pub. No. WO 02/06673.

These HFCWO systems may be used in the home, however, successful use in the home is dependent on regular use of the device by the patient. Patient compliance is also important to obtain insurance reimbursement. Ease of use is an important factor in gaining acceptable patient compliance.

BRIEF SUMMARY OF THE INVENTION

The present invention is a pneumatic high frequency chest wall oscillation device that provides greater ease of use by the patient. In particular, the present invention provides an improved air pulse generator that includes an air pulse module that produces oscillating pressure in a plurality of modes, a control for controlling operation of the air pulse module, storing programs for each mode that control the air pulse generator and responding to inputs for selecting modes; and a user interface for entering inputs to the control for selecting a mode to be performed by the air pulse module.

BRIEF DESCRIPTION OF THE DRAWINGS

FIG. 4 is a table summarizing STEP and SWEEP modes.

FIG. 5 is a table summarizing modes of the air pulse generator.

DETAILED DESCRIPTION

Figure 1:
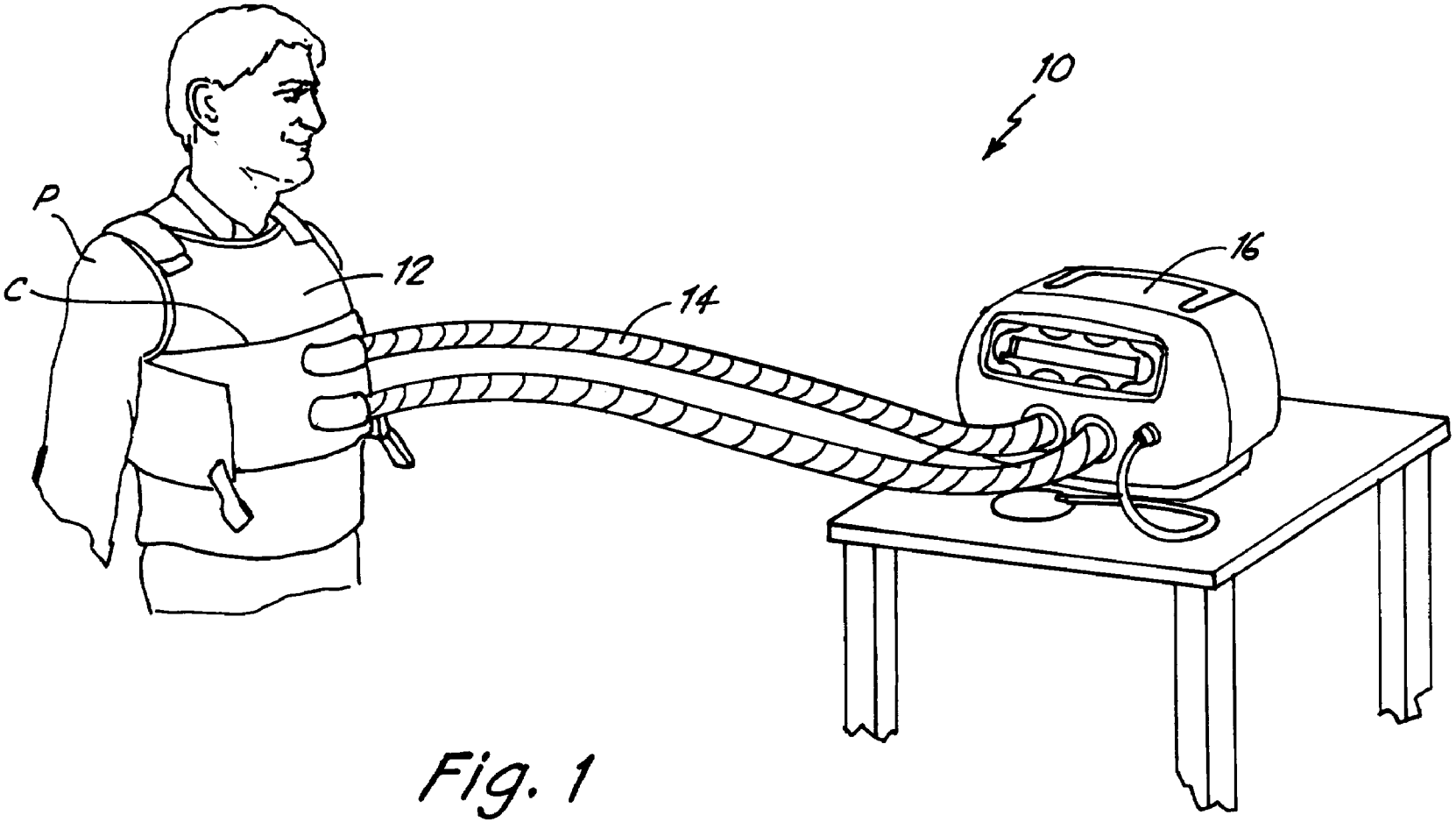
FIG. 1 is a perspective of the HFCWO system of the present invention.

FIG. 1 shows a pneumatic HFCWO system of the present invention. FIG. 1 shows patient P having chest C and system 10 which includes inflatable vest 12, hoses 14, and air pulse generator 16. Vest 12 is positioned on chest C of patient P. Hoses 14 are fluidly connected to vest 12 and air pulse generator 16.

In operation, air pulse generator 16 provides air pulses and a bias pressure to vest 12. The air pulses oscillate vest 12, while the bias pressure keeps vest 12 inflated. Vest 12 applies an oscillating compressive force to chest C of patient P. Thus, system 10 produces HFCWO to clear mucous or induce deep sputum from the lungs of patient P.

Air pulse generator 16 produces a pressure having a steady state air pressure component (or "bias line pressure") and an oscillating air pressure component. The pressure is a resulting composite waveform of the oscillating air pressure component and the steady state air pressure component. The oscillating air pressure component is substantially comprised of air pulses, while the steady state air pressure component is substantially comprised of bias line pressure.

The force generated on the chest C by vest 12 has an oscillatory force component and a steady state force component. The steady state force component corresponds to the steady state air pressure component, and the oscillating force component corresponds to the oscillating air pressure component. In a preferred embodiment, the steady state air pressure is greater than atmospheric pressure with the oscillatory air pressure riding on the steady state air pressure. With this embodiment, the resulting composite waveform provides an entire oscillation cycle of vest 12 that is effective at moving chest C of patient P, because there is no point at which pressure applied to chest C by vest 12 is below atmospheric pressure. Chest movement can only be induced while vest 12 has an effective pressure (i.e. greater than atmospheric pressure) on chest C.

Figure 2:
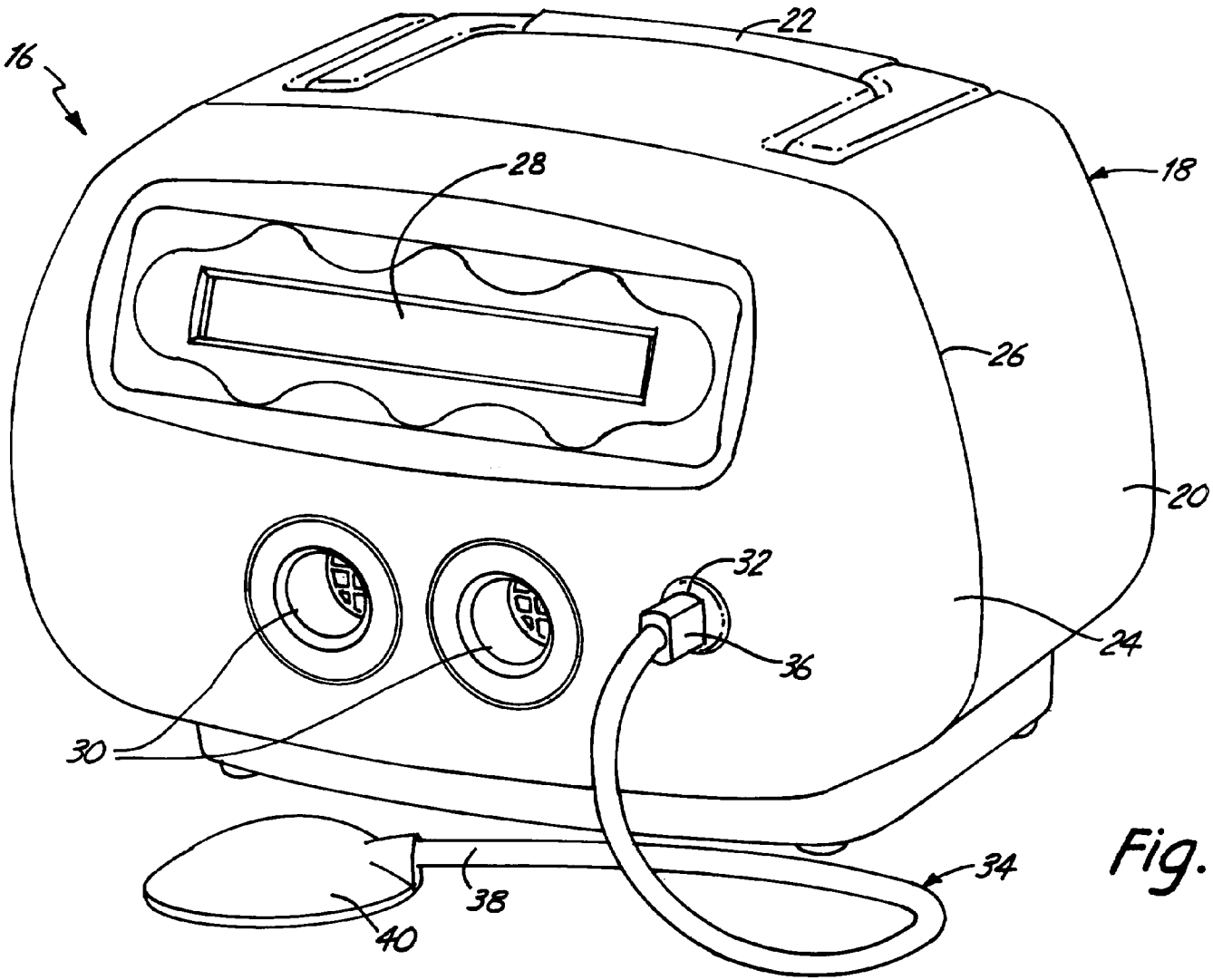
FIG. 2 is a perspective view of the air pulse generator of the present invention.

FIG. 2 shows the preferred embodiment of air pulse generator 16. Air pulse generator 16 includes shell or housing 18 having back portion 20 with handle 22, front portion 24 and seam 26. Front portion 24 further includes user interface 28, air openings 30, switch port 32 and control switch 34 having connection plug 36, tube 38 and control bulb 40. Handle 22 is connected on back portion 20 of shell 18. Front portion 24 is removably connected to back portion 20 along seam 26. Connection plug 36 connects to front portion 24 via switch port 32, and connection plug 36 fluidly connects to control bulb 40 via tube 38.

Enclosure or shell 18 is composed of molded plastic such as polyvinyl chloride (PVC). Shell 18 is preferably about 13.5 in. wide, about 9.2 in. high and about 9.2 in. deep and provides the outer covering for air pulse generator 16. Air pulse generator 16 preferably has a volume of about 1,200 in.$^3$, a foot print of about 125 in.$^2$ and weighs about 17 lbs., which is significantly smaller and lighter than prior art HFCWO air pulse generators. These dimensions easily meet airline carry-on restrictions. Most airlines require that a carry-on weigh less than 40 lbs. and have a total length, width and height of less than 45 in., but restrictions vary from airline to airline. Typically, airlines also require that a carry-on have dimensions less than 9 in.×14 in.×22 in.

In comparison, THE VEST™ system, as previously described, is about 22 in. high, 14.5 in. wide and 10.2 in. deep. THE VEST™ system, has a volume of about 3,300 in.$^3$, a footprint of about 150 in.$^2$ and weighs about 34 lbs.

Another HFCWO device, the Medpulse 2000™, from Electromed of New Prague, Minn. (various versions of which are depicted in U.S. Pat. No. 6,254,556 and Int. Pub. No. WO 02/06673) is about 20.5 in. wide, 16.75 in. deep and 9 in. high. The Medpulse 2000™ has a volume of about 3,100 in.$^3$, a footprint of about 345 in.$^2$ and also weighs about 34 lbs.

In operation, user interface 28 allows patient P to control air pulse generator 16. Air openings 30 connect hoses 14 to generator 16. Switch port 32 allows connection plug 36 to connect to air pulse generator 16. Patient P controls activation/deactivation of air pulse generator 16 through control switch 34.

Figure 3:
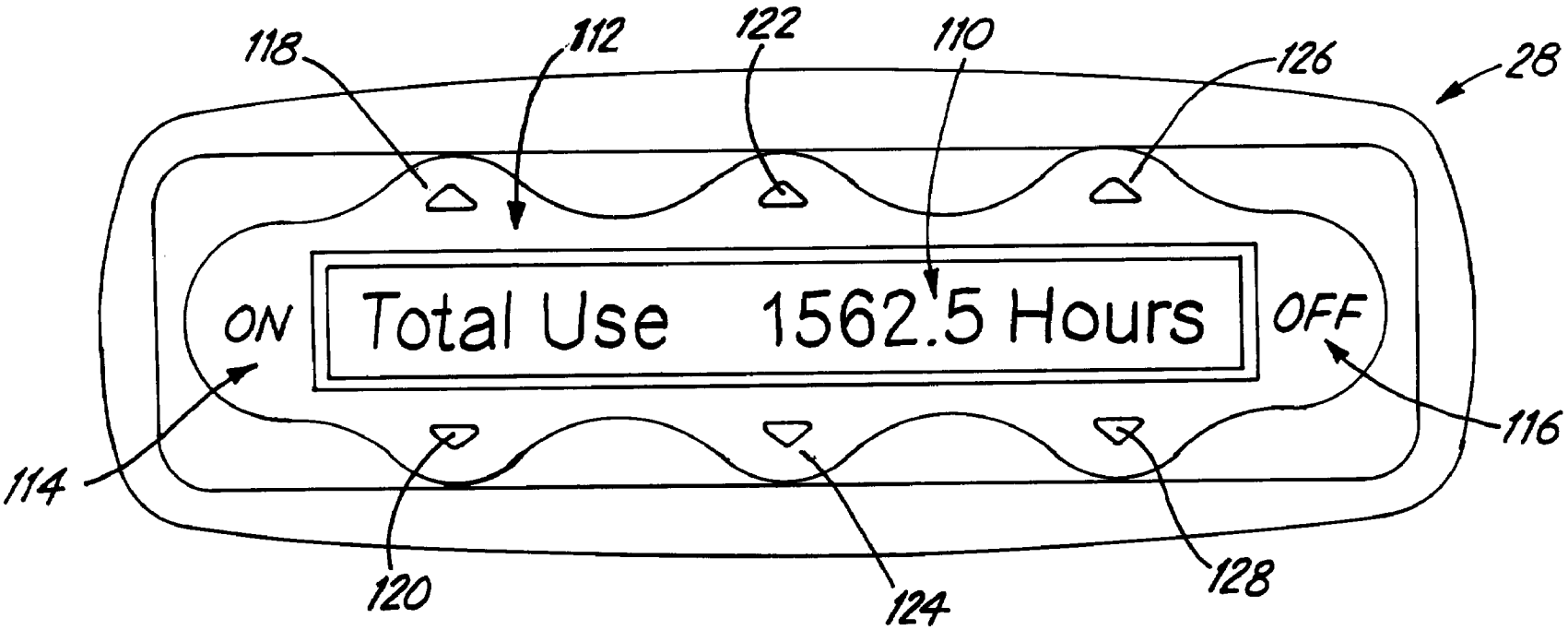
FIG. 3 is a front view of the user interface.

User interface 28 is shown in more detail in FIG. 3. User interface 28 includes display panel 110 and keypad 112 having the following buttons: ON button 114, OFF button 116, UL (Upper Left) 118, LL (Lower Left) 120, UM (Upper Middle) 122, LM (Lower Middle) 124, UR (Upper Right) 126 and LR (Lower Right) 128.

Display panel 110 is preferably an LCD panel display, although other displays, such as LED, could also be used. Display panel 110 shows the status of air pulse generator 16 and options available for usage. A single line of up to 24 characters is displayed. The characters are in a 5×8 pixel arrangement with each character measuring about 6 mm (0.24 in.)×14.54 mm (0.57 in.). A standard set of alphanumeric characters plus special symbols are used, and special characters that use any of the 40 (5×8) pixels are programmable. Display panel 110 is backlit for better character definition for all or some modes.

Keypad 112 is preferably an elastomeric or rubber eight button keypad that surrounds display panel 110. ON button 114 is located on the left side of display panel 110, and OFF button 116 is located on the right side of display panel 110. UL 118, UM 122 and UR 126 are located along the top of display panel 110, and LL 120, LM 124 and LR 128 are located along the bottom of display panel 110.

Patient P may modify operation of air pulse generator 16. Air pulse generator 16 also provides feed back to patient P as to its status. The messages are displayed as text on display panel 110.

Buttons 114–128 on user interface 28 are programmed based on the particular operating mode that is presently active. In particular, in showing operating mode choices, the arrow buttons are programed to wrap around. When showing time selection, frequency selection and pressure selection, the arrow buttons are programed to not wrap around.

The function of UL 118, LL 120, UM 122, LM 124, UR 126 and LR 128 varies depending on the current mode of air pulse generator 16. Each button is programmed to control various functions including the frequency of the oscillating air pressure component, or air pulses, the steady state air pressure component, or bias line pressure, and a timer, which deactivates air pulse generator 16 and will be more fully described below.

User interface 28 also allows operation of air pulse generator 16 in several different modes, such as MANUAL, SWEEP or STEP. Any one of which is programmable as a default mode that automatically operates when ON button 114 is activated.

MANUAL mode allows air pulse generator 16 to be manually programmed to set the oscillation frequency, bias line pressure and treatment time. MANUAL mode is similar to operation of the control knobs on THE VEST™ system. The oscillation frequency is set to a value ranging from 5 Hz to 20 Hz with a default frequency of 12 Hz. Likewise, the pressure control is set to a value ranging from 0 to 10 with a default pressure of 3. Treatment time is also set to a value ranging from 0 to 99 min with a default time of 10 min. Typically, treatment times are no more than 30 min.

SWEEP mode presets air pulse generator 16 to sweep over a range of oscillation frequencies while maintaining the same bias or steady state air pressure component. SWEEP mode provides three different sweep ranges, although any number or range of frequencies are programmable through user interface 28. The table shown in FIG. 4 summarizes and illustrates the three different sweep ranges, which are: HIGH, which sweeps the oscillation frequency between 10 to 20 Hz; NORMAL, which sweeps the oscillation frequency between 7 and 17 Hz and LOW, which sweeps the oscillation frequency between 5 and 15 Hz. In each of these modes, the oscillation frequency sweeps between the two end points incrementally changing the oscillation frequency. The oscillation frequency incrementally increases until it reaches the high frequency, then incrementally decreases the oscillation frequency to the low frequency, then the oscillation frequency incrementally increases again (FIG. 4). Alternatively, the oscillation frequency incrementally increases to the high frequency then returns to the low frequency and incrementally increases to the high frequency. The incremental increasing and decreasing continues throughout the treatment, or until the settings are reset. It is believed that the low frequencies are more effective at clearing small airways, and high frequencies more effective at clearing larger airways. The speed of the sweep is programmable through user interface 28 or preset. Preferably, the sweep speed is 1 cycle per 5 minutes. The default pressure setting in SWEEP mode is 3 with patient P able to modify the setting from 1 to 4 for comfort.

STEP mode presets air pulse generator 16 to step over a range of oscillation frequencies while maintaining the same bias or steady state air pressure component. STEP mode provides three different step ranges, although any number or range of frequencies is programmable through user interface 28. Again, the table shown in FIG. 4 summarizes and illustrates the different ranges of STEP mode, which are: HIGH, which steps through the oscillation frequencies 10 Hz, 13 Hz, 16 Hz and 19 Hz; NORMAL, which steps through the oscillation frequencies 8 Hz, 11 Hz, 14 Hz and 17 Hz and LOW, which steps through the oscillation frequencies 5 Hz, 8 Hz, 11 Hz and 14 Hz. In each of these modes the oscillation frequencies step from the low frequency to the high frequency, changing the oscillation frequency a fixed amount after a fixed period of time. The oscillation frequency increases by steps until it reaches the high frequency, then decreases the oscillation frequency until the low frequency is reached. If desired, the oscillation frequency increases by steps again. The pattern of increasing and decreasing continues throughout the treatment or until the settings are reset. The fixed step amount of oscillation frequency change and the fixed period between oscillation frequency changes is programmable through user interface 28, or the fixed step amount and the fixed period are preset. Preferably, the fixed step amount is 3 Hz, and the fixed step time period is 5 minutes. The default mode for STEP and SWEEP modes is NORMAL, and the default pressure is 3 with patient P able to modify the pressure from 1 to 4.

The table in FIG. 5 summarizes default mode settings and buttons 118–128 functionality in specific modes. The first column lists each mode.

Columns 2–6 list the default settings for different parameters of HFCWO while in the various modes. Columns 7–9 list the function of buttons 118–128 while in the various modes.

The following operating modes are software supported by air pulse generator 16: A) UNPLUGGED, B) IDLE, C) AUTO READY, D) AUTO RUN, E) AUTO PAUSED, F) PROGRAM ADJUST, G) PROGRAM RUN, H) MANUAL ADJUST, I) ERROR, J) Pulsing therapy modes including SWEEP, STEP and MANUAL and K) status and user messages including pressure adjust and frequency adjust, session run time (including pulsing and pause time) and accumulated run time (updated in memory every one minute).

In UNPLUGGED mode, display panel 110 is blank and air pulse generator 16 is disconnected from the supply mains.

In IDLE mode, air pulse generator 16 is plugged in and both blower motor 50 and diaphragm motor 64 are non-operational. Display panel 110 is not back lit, but the displayed message can be read and indicates accumulated run time (either both pulsing or pause time or only pulsing time).

The operation of control switch 34 is also programmed through user interface 28. Control switch 34 is used in either an ON/OFF mode or a CONSTANTLY ON mode. The CONSTANTLY ON mode requires that control switch 34 be constantly depressed in order to activate air pulse generator 16. The ON/OFF mode activates or deactivates air pulse generator 16 each time control switch 34 is pressed. The ON button 114 can also be used alternatively or to duplicate the functions of control switch 34.

Buttons 114–128 and control switch 34 have the following functionality in IDLE mode: A) control switch 34 causes air pulse generator 16 to enter AUTO RUN mode using the default settings, B) ON button 114 causes air pulse generator 16 to enter AUTO READY mode, C) OFF button 116 has no effect and air pulse generator 16 remains in IDLE mode and D) buttons 118-128 are nonfunctional.

In AUTO READY mode, air pulse generator 16 pressurizes vest 12 for four seconds to the standby pressure level of 0.1 psi+0.05/−0.0.03 psi, and the backlit display panel 110 toggles between the default-remaining session time (e.g. "SWEEP NORMAL 20 MIN") and status (e.g."READY-PRESS AIR SWITCH") messages every two seconds. Air pulse generator 16 continues alternating messages in AUTO READY mode for two minutes unless operator action occurs. After two minutes, air pulse generator 16 enters IDLE mode where vest 12 deflates, and a message displaying "INCOMPLETE XX MIN REMAIN" is displayed for five seconds.

Buttons 114–128 and control switch 34 have the following functionality in AUTO READY mode: A) control switch 34 causes air pulse generator 16 to enter AUTO RUN mode, B) ON button 114 causes air pulse generator 16 to enter PROGRAM ADJUST mode, C) OFF button 116 causes air pulse generator 16 to enter IDLE mode and D) buttons 118–128 are nonfunctional. Air pulse generator 16 returns to IDLE mode after two minutes of inactivity and displays "INCOMPLETE XX MIN REMAIN."

In AUTO RUN mode, air pulse generator 16 inflates vest 12 for four seconds and then begins oscillation by initially performing a pressure characterization. During pressure characterization, sinusoidal pressure pulses are supplied over an average static pressure. During the initial few slow oscillation pulses of air pulse generator 16 during RUN mode, air pulse generator 16 monitors the system pressure and makes an adjustment to the average static pressure to compensate for different vest sizes and varying vest tightness. Patient P may be allowed to modify this average static pressure.

The pressure in vest 12 is comparable to the pressure in the air chamber of air pulse generator 16 at low frequencies such as 5 Hz. The correlation between the pressure in the air chamber and the pressure in vest 12 is not as comparable at high frequencies such as 15 or 20 Hz. This method allows the pressure in vest 12 to be accurately measured and maintained by taking measurements in the air chamber instead of taking measurements in vest 12. Eliminating electronics in the vest portion increases safety. Once the average static pressure is determined, the pressure is maintained by maintaining the speed of the blower providing the bias line pressure with the tip speed of the blower fan. By using a blower with a flat pressure curve over the range of air flow, the average static pressure is maintained by simply maintaining the speed of the blower.

Oscillation proceeds using the default settings of SWEEP NORMAL for a duration of 20 minutes, while the backlit display panel 110 shows relative pressure (using vertical bars) and remaining session time. The message is displayed while air pulse generator 16 is delivering pulsed air pressure to vest 12. The time counts down to zero in whole minute increments. When the session is complete, air pulse generator 16 reverts to IDLE mode and displays the message "SESSION COMPLETE" for five seconds.

Buttons 114–128 and control switch 34 have the following functionality in AUTO RUN mode: A) control switch 34 causes air pulse generator 16 to enter AUTO PAUSE mode, B) ON button 114 has no effect, C) OFF button 116 causes air pulse generator 16 to enter IDLE mode, D) UL 118 and LL 120 adjust vest pressure and E) buttons 122–128 are nonfunctional.

In AUTO PAUSED mode, air pulse generator 16 lowers vest pressure to the standby pressure level. Display panel 110 toggles between the default mode-remaining session time (e.g. "SWEEP NORMAL XX MIN") and air pulse generator 16 status (e.g. "PAUSED PRESSED AIR SWITCH") messages every two seconds. Air pulse generator 16 continues alternating messages in AUTO PAUSED mode for two minutes unless operator action occurs. After two minutes of inactivity, air pulse generator 16 enters IDLE mode causing vest 12 to deflate, and the message "INCOMPLETE XX MIN REMAIN" is displayed for five seconds.

Buttons 114–128 and control switch 34 have the following functionality in AUTO PAUSED mode: A) control switch 34 causes air pulse generator 16 to enter AUTO RUN mode, continuing the paused therapy session, B) ON button 114 has no effect, C) OFF button 116 causes air pulse generator 16 to enter IDLE mode and D) buttons 118–128 are nonfunctional.

PROGRAM ADJUST mode maintains the vest pressure established in AUTO READY mode, or lowers the vest pressure to the standby pressure level if pausing from RUN mode. If proceeding from AUTO READY mode, display panel 110 will toggle between "SWEEP NORMAL 20 MIN" and "READY-PRESS AIR SWITCH" messages every two seconds. If paused from PROGRAM RUN mode, display panel 110 toggles between the current settings of "MODE-FREQ MODIFIER-REMAINING SESSION TIME" (e.g. "SWEEP NORMAL 5 MIN", "STEP HI 17 MIN", OR "MANUAL ADJUST ?") and "PAUSED-PRESS AIR SWITCH" messages every two seconds.

The different modes (SWEEP, STEP and MANUAL) are accessed using UtL 118 and LL 120. When SWEEP and STEP modes are displayed, the frequency modifiers (HIGH, LOW and NORMAL) are adjusted using UM 122 and LM 124, and the session time (in minutes) is set using UR 126 and LR 128. As the modes and modifiers are changed, they replace the "SWEEP NORMAL TIME" message. The mode message continues to alternate with the "READY-PRESS AIR SWITCH" or "PAUSED-PRESS AIR SWITCH" messages every two seconds. (Note: "READY" is used when PROGRAM ADJUST mode is reached from AUTO READY mode, and "PAUSED" is used when reached from RUN mode.)

Pressing control switch 34 at any time causes air pulse generator 16 to proceed to PROGRAM RUN mode using the displayed settings. If time is zero when control switch 34 is pressed, air pulse generator 16 reverts to IDLE mode. Pressing UL 118, UM 122, LL 120 or LM 124 while in "MANUAL ADJUST?"transfers air pulse generator 16 to MANUAL ADJUST mode where frequency, pressure and session time can be adjusted. Messages continue alternating in PROGRAM ADJUST mode for two minutes unless operator action occurs. After two minutes, air pulse generator 16 reverts to IDLE mode where vest 12 deflates, and a message "INCOMPLETE XX MIN REMAIN" is displayed for five seconds.

Buttons 114–128 and control switch 34 have the following functionality in PROGRAM ADJUST mode: A) control switch 34 causes air pulse generator 16 to enter RUN mode (Actual RUN mode depends on setting at time of control switch 34 actuation. If control switch 34 is actuated with the session time at zero, air pulse generator 16 will reset to the IDLE mode.), B) ON button 114 has no effect, C) OFF button 116 causes air pulse generator 16 to enter IDLE mode, D) UL 118 and LL 120 toggle SWEEP, STEP and MANUAL modes, E) UM 122 and LM 124 adjust the frequency in SWEEP and STEP modes and cause transfer to MANUAL ADJUST in MANUAL mode and F) UR 126 and LR 128 adjust the time in SWEEP and STEP modes and cause transfer to MANUAL ADJUST in MANUAL mode. Air pulse generator 16 returns to IDLE mode after two minutes of inactivity displaying "INCOMPLETE XX MIN REMAIN."

MANUAL ADJUST mode maintains vest 12 inflation at standby pressure and pulsing action remains stopped. The backlit display panel 110 shows the default or previously paused session information of frequency setting in Hertz, relative pressure and remaining session time in minutes. Adjustments to each of the parameters (frequency, pressure or time) are made by pressing the respective up or down arrow buttons.

Buttons 114–128 and control switch 34 have the following functionality in MANUAL ADJUST mode: A) control switch 34 causes air pulse generator 16 to enter MANUAL RUN mode (if control switch 34 is activated with the session time at zero, air pulse generator 16 will revert to IDLE mode), B) ON button 114 has no effect, C) OFF button 116 causes air pulse generator 16 to enter IDLE mode, D) UL 118 and LL 120 adjust frequency in Hertz, E) UM 122 and LM 124 adjust relative pressure and F) UR 126 and LR 128 adjust session time in minutes.

Air pulse generator 16 returns to IDLE mode after two minutes. If the session time has elapsed, air pulse generator 16 returns to PROGRAM ADJUST mode displaying "SESSION COMPLETE" for five seconds and then displaying "MANUAL ADJUST?"

In PROGRAM RUN mode, vest 12 inflates for four seconds and air pulse generator 16 begins pulsing in the selected mode: SWEEP, STEP or MANUAL. Each mode is described below in further detail.

In MANUAL RUN mode, vest 12 inflates for four seconds and air pulse generator 16 begins pulsing the selected or default parameters. No pressure characterization is required in MANUAL RUN mode. Display panel 110 is backlit and shows frequency settings in Hertz, relative pressure setting and remaining session time in minutes. The message is displayed while air pulse generator 16 is delivering pulsed air pressure to vest 12. The time counts down to zero as whole minute increments. Adjustments to each of the parameters can be made by pressing the adjacent up or down arrow buttons.

Buttons 114–128 and control switch 34 have the following functionality in MANUAL RUN mode: A) control switch 34 causes air pulse generator 16 to enter PROGRAM ADJUST mode and the settings are remembered, B) ON button 114 has no effect, C) OFF button 116 causes air pulse generator 16 to enter IDLE mode, D) UL 118 and LL 120 adjust frequency in Hertz, E) UM 122 and LM 124 adjust relative vest pressure and F) UR 126 and LR 128 adjust time in minutes.

Once the session time is completed, air pulse generator 16 returns to PROGRAM ADJUST mode with initial session settings. When the session timer counts to zero, the pulsing stops, vest pressure drops to standby, and air pulse generator 16 resets to the session values previously entered. If air pulse generator 16 is further reset to IDLE mode, the session values of frequency, pressure and time are lost, and the default values are loaded.

In SWEEP RUN and STEP RUN modes, air pulse generator 16 inflates vest 12 for four seconds and then begins oscillation by initially performing the pressure characterization described above. Oscillation proceeds through the pre-selected or default sweep settings while the backlit display panel 110 shows relative pressure (using vertical bars) and remaining session time. The message on display panel 110 is displayed while air pulse generator 16 is delivering pulsed air pressure to vest 12. The time counts down to zero in whole minute increments.

Buttons 114–128 and control switch 34 have the following functionality in SWEEP RUN and STEP RUN modes: A) control switch 34 causes air pulse generator 16 to enter PROGRAM ADJUST mode, B) ON button 114 has no effect, C) OFF button 116 causes air pulse generator 16 to enter IDLE mode, D) UL 118 and LL 120 adjust vest pressure and E) buttons 122–128 are non-functional.

Once time is completed, air pulse generator 16 returns to IDLE mode and displays "SESSION COMPLETE" for five seconds. Pulsing stops, vest 12 deflates, session settings are lost, and the default values are loaded if SWEEP RUN or STEP RUN mode is re-entered.

When an error is detected, air pulse generator 16 reverts to IDLE mode and displays the non-backlit error message "See Manual." Only UNPLUGGED mode is allowed. If air pulse generator 16 is unplugged and replugged, the message clears, and air pulse generator 16 attempts to run again. Buttons 114–128 and control switch 34 have no effect. Air pulse generator 16 continues to alternate Error and Call messages.

Air pulse generator 16 provides a static pressure produced by a centrifugal blower with an electric feedback speed control loop for controlling the pressure. A pressure offset is generated during the startup period, which compensates for the different bladder sizes available in the assorted vest options. Average minimum output pressure is 0.28 psi minimum, the average maximum output pressure is 0.70 psi minimum, and the average IDLE output pressure is 0.1 psi nominal and the maximum pressure is 1.2 psi. The pressure setting and the actual operating average pressure tolerance is 0.2 psi.

The air pulse frequency is generated by a DC brushless motor driving a double linkage connected to two natural rubber diagrams, which is described in more detail below. The minimum air pulse frequency is 5 Hz, and the maximum air pulse frequency is 20 Hz. The pulse frequency delivered by air pulse generator 16 is 20% of the selected parameter. The maximum peak pressure, measured at the input port of vest 12, does not exceed 1.2 psi at any pulse frequency (5–20 Hz), using any vest size and any pressure setting.

The pressure oscillates causing pressure fluctuations that are the result of dual diaphragm oscillations of a fixed volume displacement of 29.2 in.$^3$ per cycle. The pressure fluctuations at vest 12 are: A) a minimum level of 0 psi, B) a maximum level of 1.2 psi maximum, C) a maximum of 0.45 psi minimum and D) a minimum pressure delta of 0.15 psi.

Figure 6:
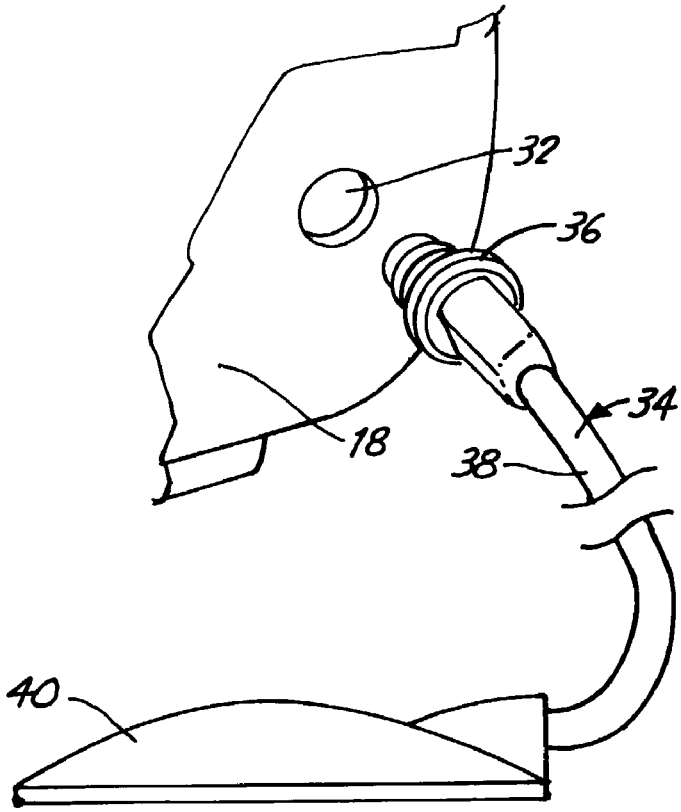
FIG. 6 is a perspective view of one embodiment of the control switch.

FIG. 6 shows one embodiment of control switch 34 in more detail. FIG. 6 includes shell 18 with switch port 32 and control switch 34 having connection plug 36, tube 38 and control bulb 40. Connection plug 36 connects control switch 34 to air pulse generator 16.

Control switch 34 is similar to control switches used on prior art devices, such as the pneumatic control switch used with THE VEST™ airway clearance system from Advance Respiratory, Inc., St. Paul, Minn. Control switch 34 is activated by compressing control bulb 40, such as with a hand or a foot of patient P. Upon compression, control bulb 40 sends an air pulse through tube 38 to a pneumatic switch, which activates/deactivates air pulse generator 16. Control switch 34 operates as a toggle switch when depressed and released.

Figure 7:
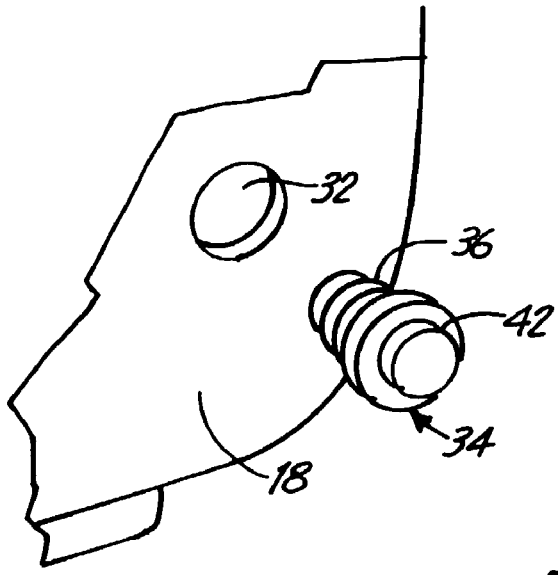
FIG. 7 is a perspective view of a second embodiment of the control switch.

FIG. 7 shows a second embodiment of control switch 34. Here, control switch 34 includes connection plug 36 and button bulb 42. Button bulb 42 is a small pneumatic bulb comprised of plastic, such as 60 durometer PVC, directly connected to connection plug 36. Button bulb 42 may have a bleed hole to relieve pressure. Control switch 34 is inserted in switch port 32 of shell 18. Button bulb 42 eliminates the need for tube 38 and provides an on/off/pause control next to user interface 28 for convenience and ease of use. Similar to the first embodiment described in FIG. 6, control switch 34 shown in FIG. 7 sends an air pulse to a pneumatic switch, which activates/deactivates air pulse generator 16. Again, control switch 34 operates as a toggle switch when depressed and released.

Figure 8:
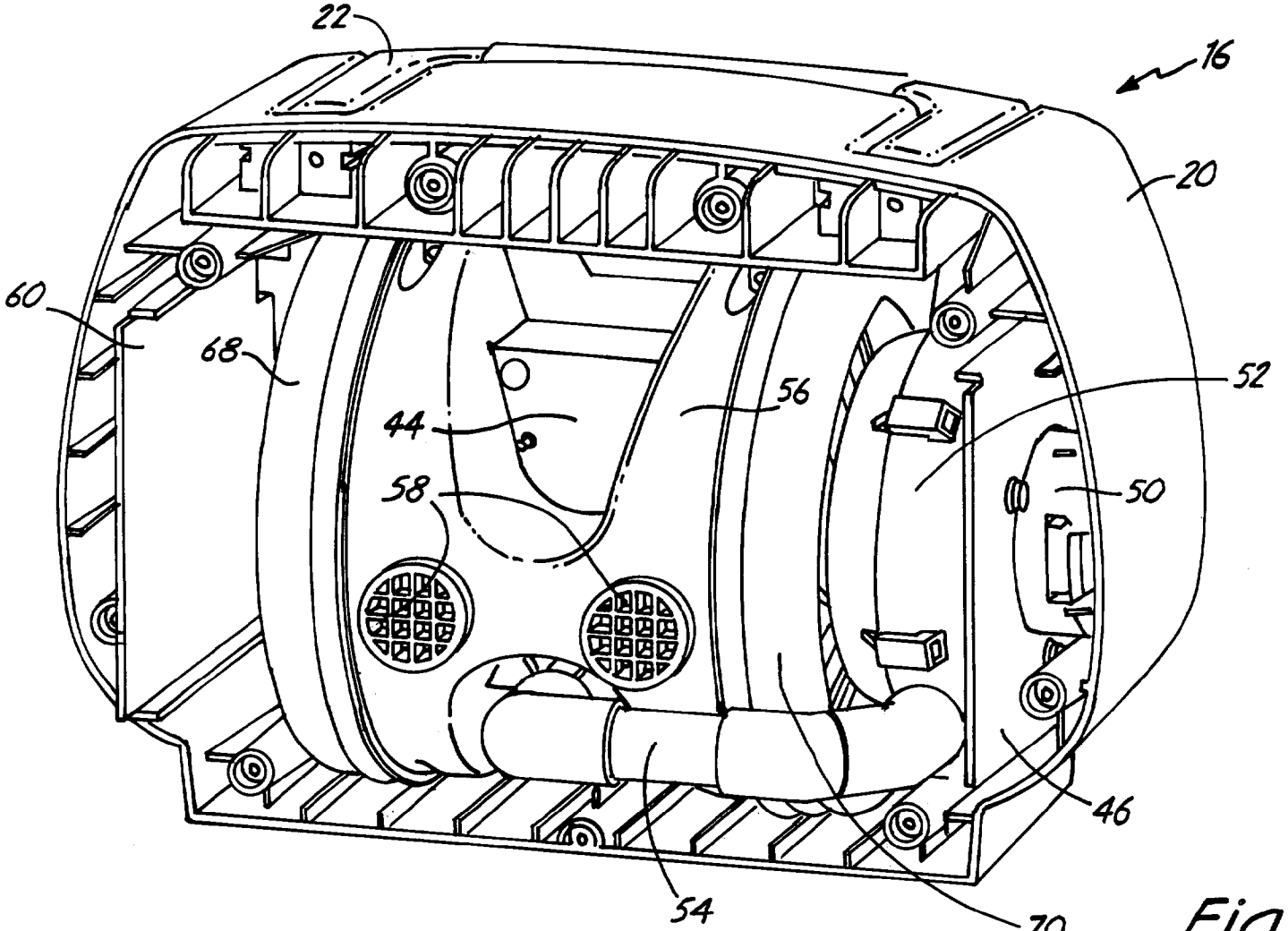
FIG. 8 is a perspective view of the inside of the air pulse generator with a front portion of the shell removed.

FIG. 8 shows air pulse generator 16 with front portion 24 removed. Air pulse generator 16 includes back portion 20 with handle 22, air pulse module 44, mounting plate 46 and main control board 60. Air pulse module 44 further includes blower motor 50, blower 52, tube 54 and air chamber assembly 56 with air ports 58, first diaphragm assembly 68 and second diaphragm assembly 70. In the one embodiment, mounting plate 46 secures air pulse module 44 to shell 18. Blower motor 50 is connected to blower 52. Tube 54 fluidly connects blower 52 to air chamber assembly 56, and first and second diaphragm assemblies 68 and 70 are positioned on opposite sides of air chamber assembly 56. Main control board 60 is preferably secured within shell 18 opposite mounting plate 46.

The oscillatory air pressure component is created by the pulsing action of first and second diaphragm assemblies 68 and 70, which oscillates the air within air chamber assembly 56 at a selected frequency. The oscillatory pressure created by first and second diaphragm 68 and 70 follows a sinusoidal waveform pattern.

To create the steady state air pressure, blower motor 50 powers blower 52 to provide a bias line pressure to air chamber assembly 56 through tube 54. Air within air chamber assembly 56 oscillates to provide the air pulses to vest 12. Blower motor 50 and blower 52 may be, for example, an Ametek model 119319 or Torrington 1970-95-0168. Preferably, the steady state air pressure created by blower 52 is greater than atmospheric pressure, so that a whole oscillatory cycle is effective at moving chest C of patient P.

Figure 9:
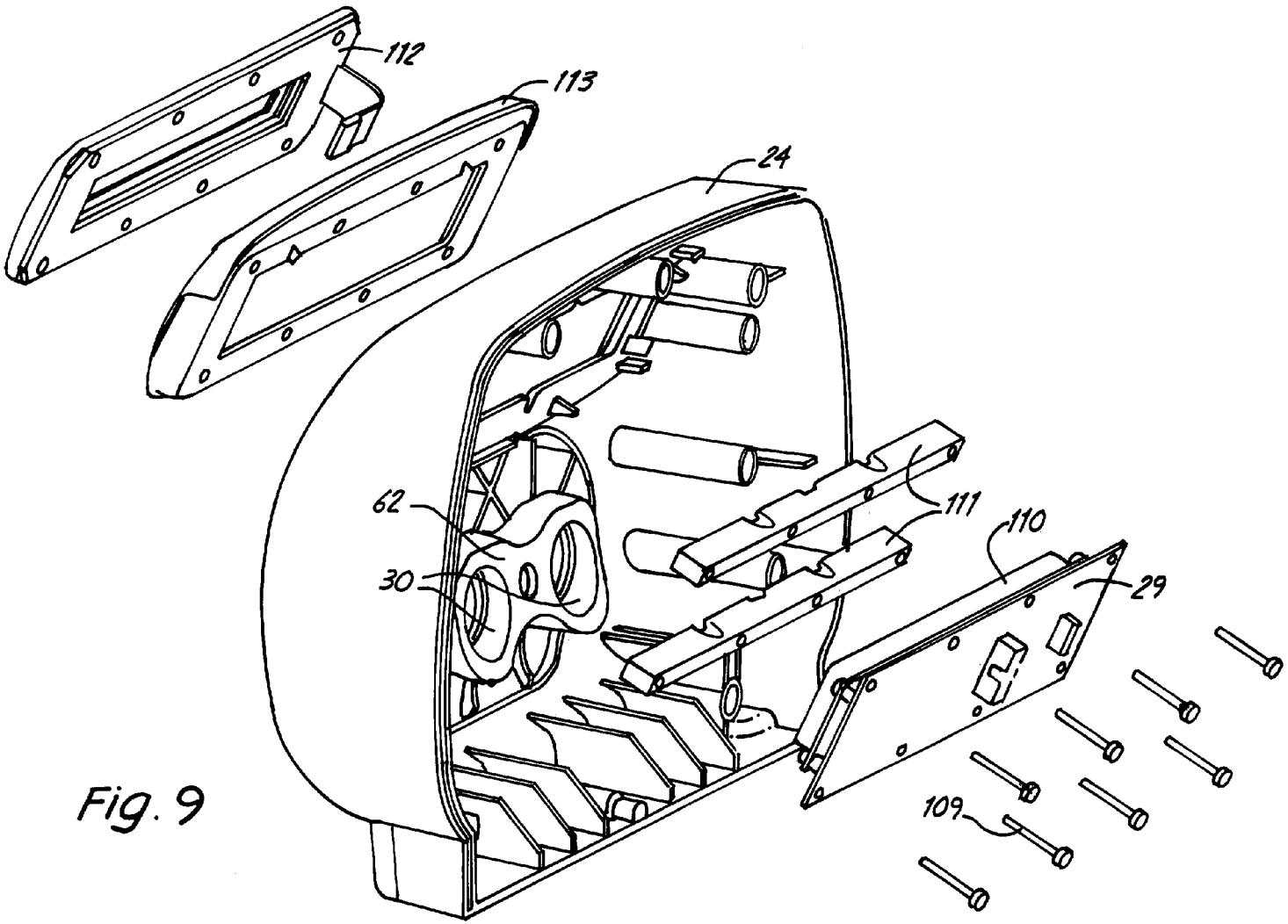
FIG. 9 is an exploded view of the inside of the front portion of the shell.

FIG. 9 shows an exploded view of front portion 24 of shell 18. Front portion 24 includes keypad 112, surround 113, anchors 111, display panel 110, secondary control board 29, fasteners 109, air openings 30 and seal 62. Keypad 112 fits into surround 113, which fits onto the outside of front portion 24. Anchors 111 are on the inside of front portion 24 such that display panel 110 fits between anchors 111 to secure display panel 110 in place. Secondary control board 29 is attached on the back side of display panel 110 and contains electronic circuitry for user interface 28, which is detailed below. Fasteners 109 secure keypad 112, surround 113, anchors 111 and display panel 110 with secondary control board 29 together to form user interface 28. Fasteners 109 further secure user interface 28 to front portion 24.

Seal 62 is positioned between the front of air pulse module 44 and front portion 24. Seal 62 is fitted around air openings 30 and air ports 58 to form an air tight connection between hoses 14 and air pulse module 44.

When air pulse generator 16 is operating, essentially all of the pulsed air is transferred from air pulse module 44 to hoses 14. Seal 62 is preferably comprised of an elastomer such as black nitrile having a durometer of 80+/−5. However, seal 62 may also be comprised of closed cell foam tape, or black vinyl type foam.

Figure 10:
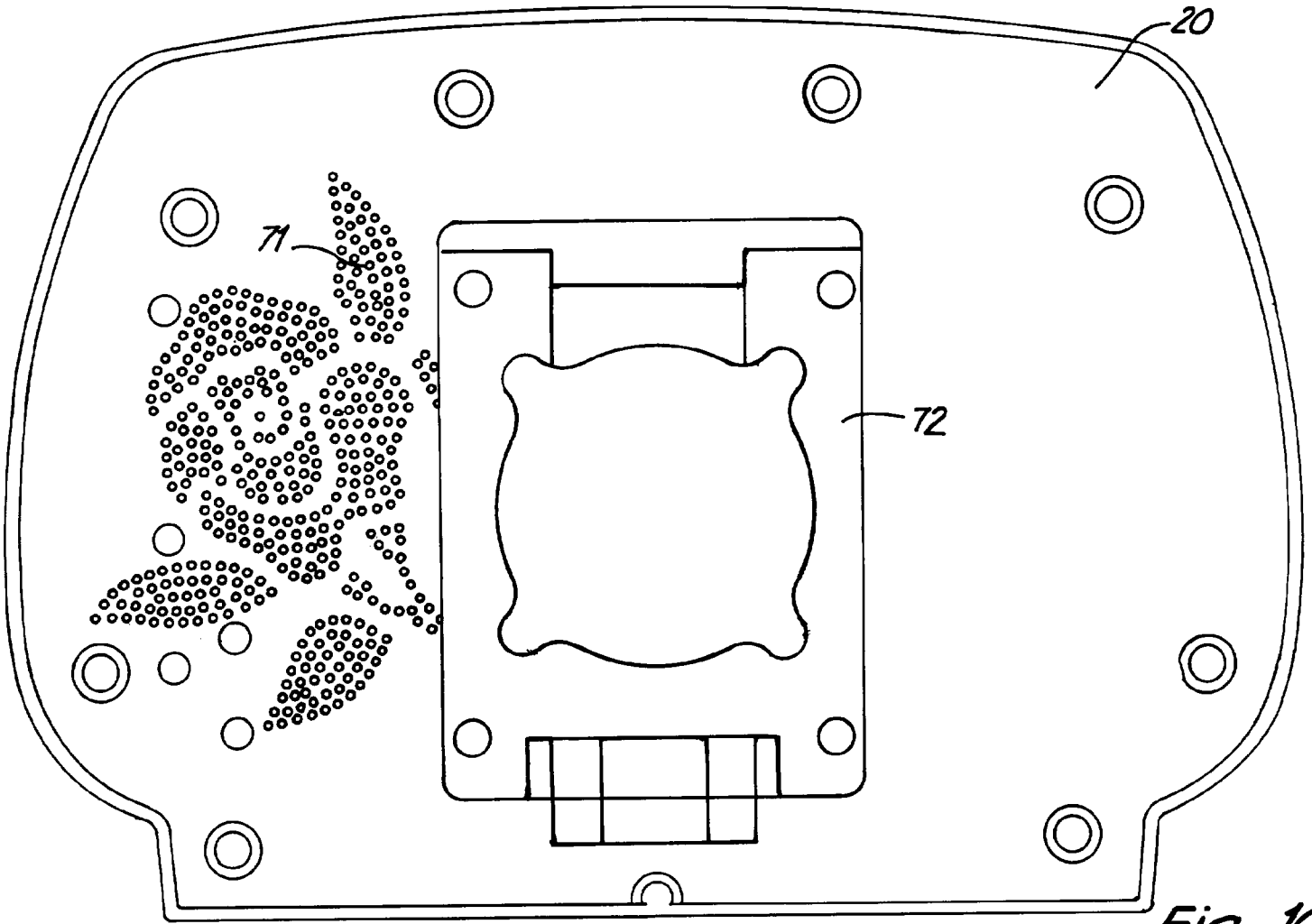
FIG. 10 is a perspective view of the inside of the back portion of the shell.

FIG. 10 is an inside view of back portion 20 of shell 18. Back portion 20 includes vent 71 and support 72. Support 72 is positioned between the back of air pulse module 44 and back portion 20 to secure air pulse module 44 within shell 18 and reduce noise and vibration produced by air pulse generator 16. Support 72 is also designed such that air circulates around diaphragm motor 64 (FIG. 12) to dissipate heat, thus preventing diaphragm motor 64 from overheating. Support 72 is preferably one piece but may be comprised of two or more individual supports. Support 72 is comprised of an elastomer such as black nitrile having a durometer of 60+/−5 shaped to conform to the surrounding parts but may alternatively be comprised of closed cell foam tape or black vinyl type foam.

Vent 71 is a region of back portion 20 having openings through shell 18. Vent 71 is positioned such that heat from diaphragm motor 64, secondary control board 29 and/or main control board 60 is released through vent 71 to prevent overheating.

Figure 11:
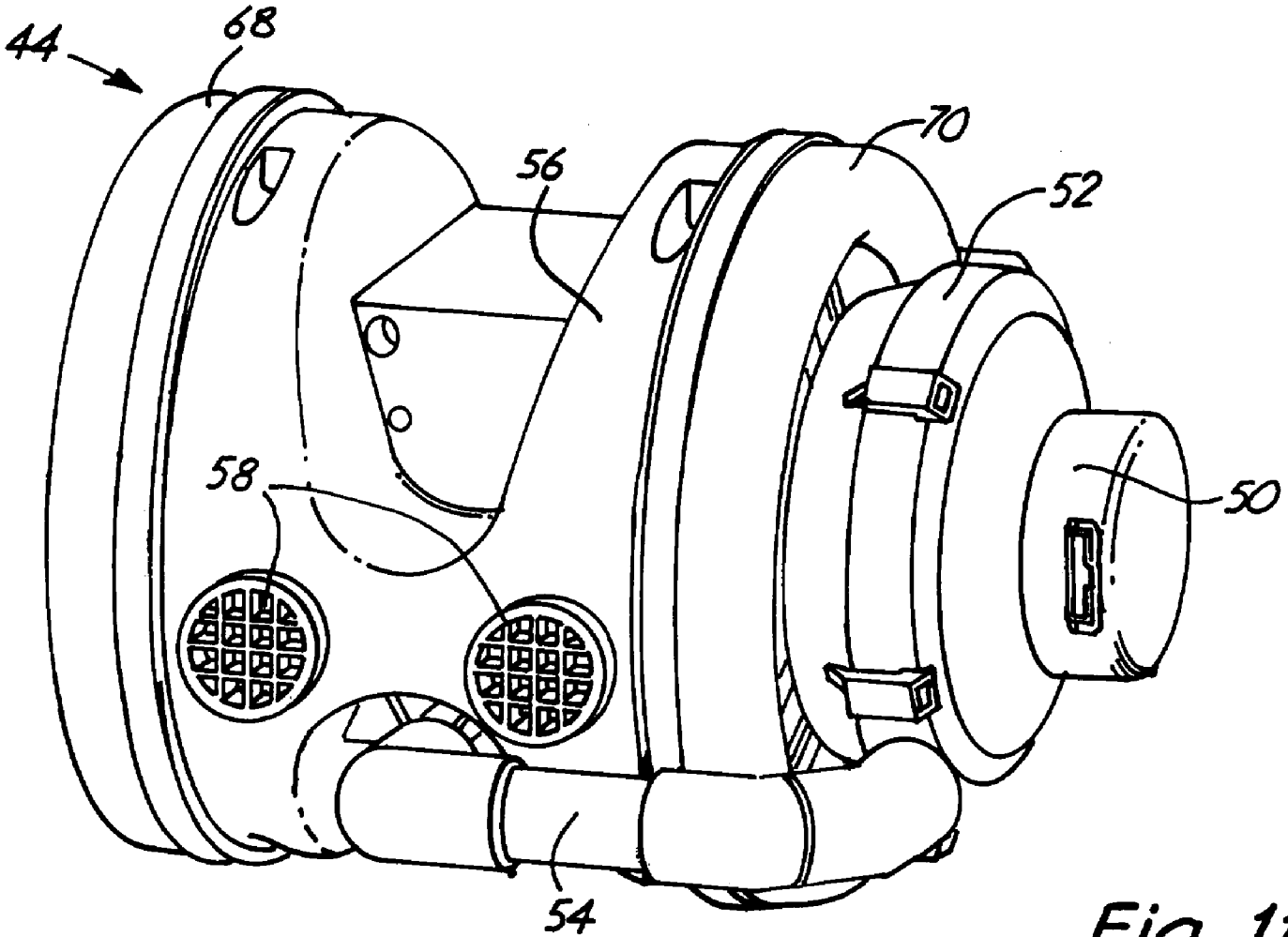
FIG. 11 is a perspective view of the air pulse module.

FIG. 11 shows the front of air pulse module 44 with more clarity. Air pulse module 44 includes blower motor 50, blower 52, tube 54 and air chamber assembly 56 with air ports 58, first diaphragm assembly 68 and second diaphragm assembly 70. Refer to FIG. 8 for a description of the general function of air pulse module 44.

Figure 12:
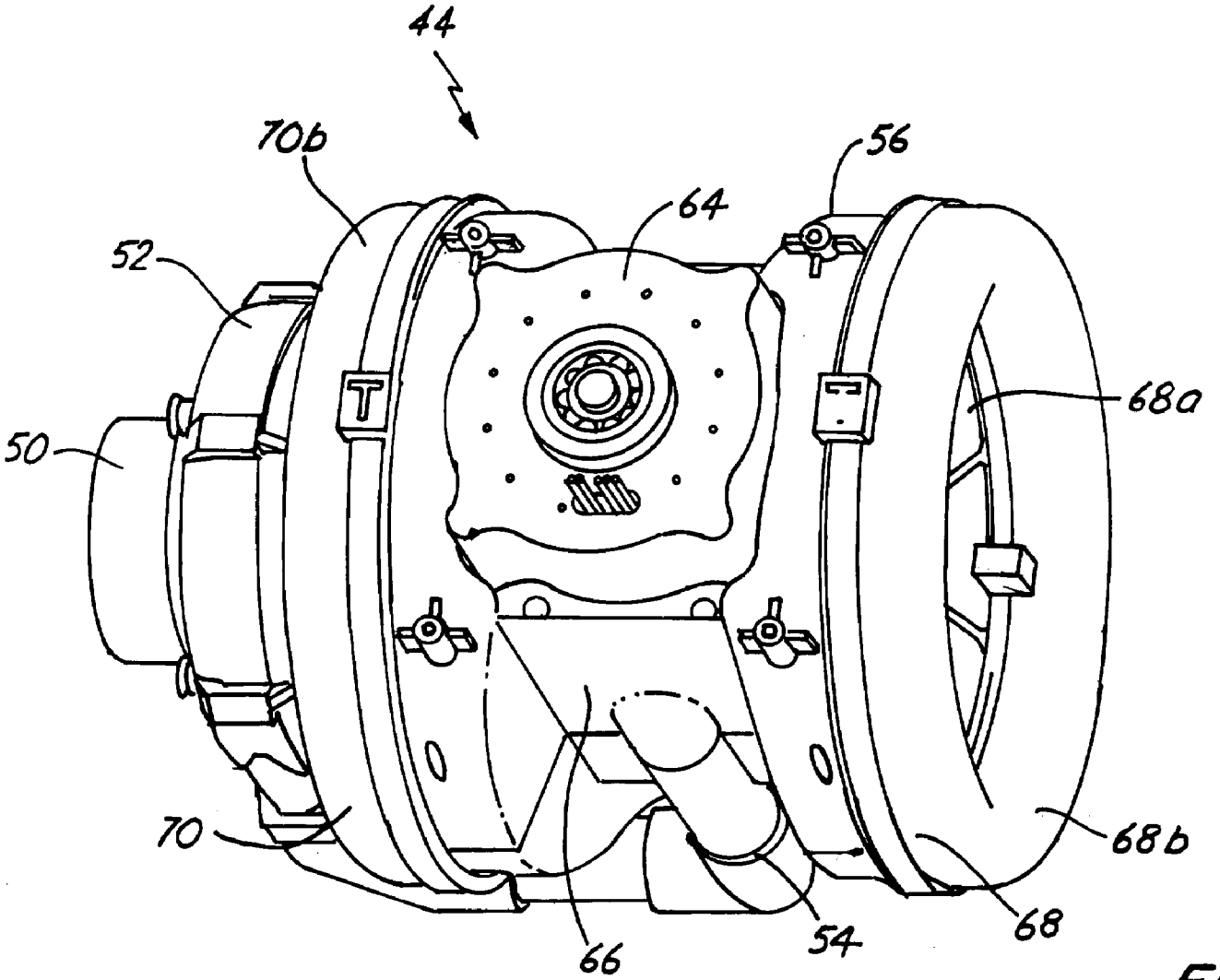
FIG. 12 is a perspective view of the back side of the air pulse module.

FIG. 12 shows the back of air pulse module 44. Air pulse module 44 includes blower motor 50, blower 52, tube 54 and air chamber assembly 56 having diaphragm motor 64, air chamber shell 66, first diaphragm assembly 68 and second diaphragm assembly 70. First diaphragm assembly 68 further includes plate 68*a* and diaphragm seal 68*b*. Second diaphragm assembly 70 further includes plate 70*a* (not shown) and diaphragm seal 70*b*.

Diaphragm motor 64 is directly mounted on air chamber shell 66 at the back of air pulse module 44. Diaphragm motor 64 may be an Aspen Motion Research Part No. 11702 or an equivalent motor. First diaphragm assembly 68 and second diaphragm assembly 70 are movably attached on opposite sides of air chamber shell 66.

Diaphragm seals 68*b* and 70*b* have an annular U shape and are comprised of a flexible material such as natural rubber, silicon rubber, or nitrile rubber. Plates 68*a* and 70*a* are comprised of metal, such as aluminum, and are substantially flat. Diaphragm seals 68*b* and 70*b* provide a fluid type seal between plates 68*a* and 70*a*, respectively, and air chamber shell 66. Air chamber shell 66, first diaphragm assembly 68, second diaphragm assembly 70 and diaphragm motor 64 substantially define an air chamber. In operation, diaphragm motor 64 powers movement of first diaphragm assembly 68 and second diaphragm assembly 70 to oscillate air within the air chamber, which is detailed below.

Figure 13:
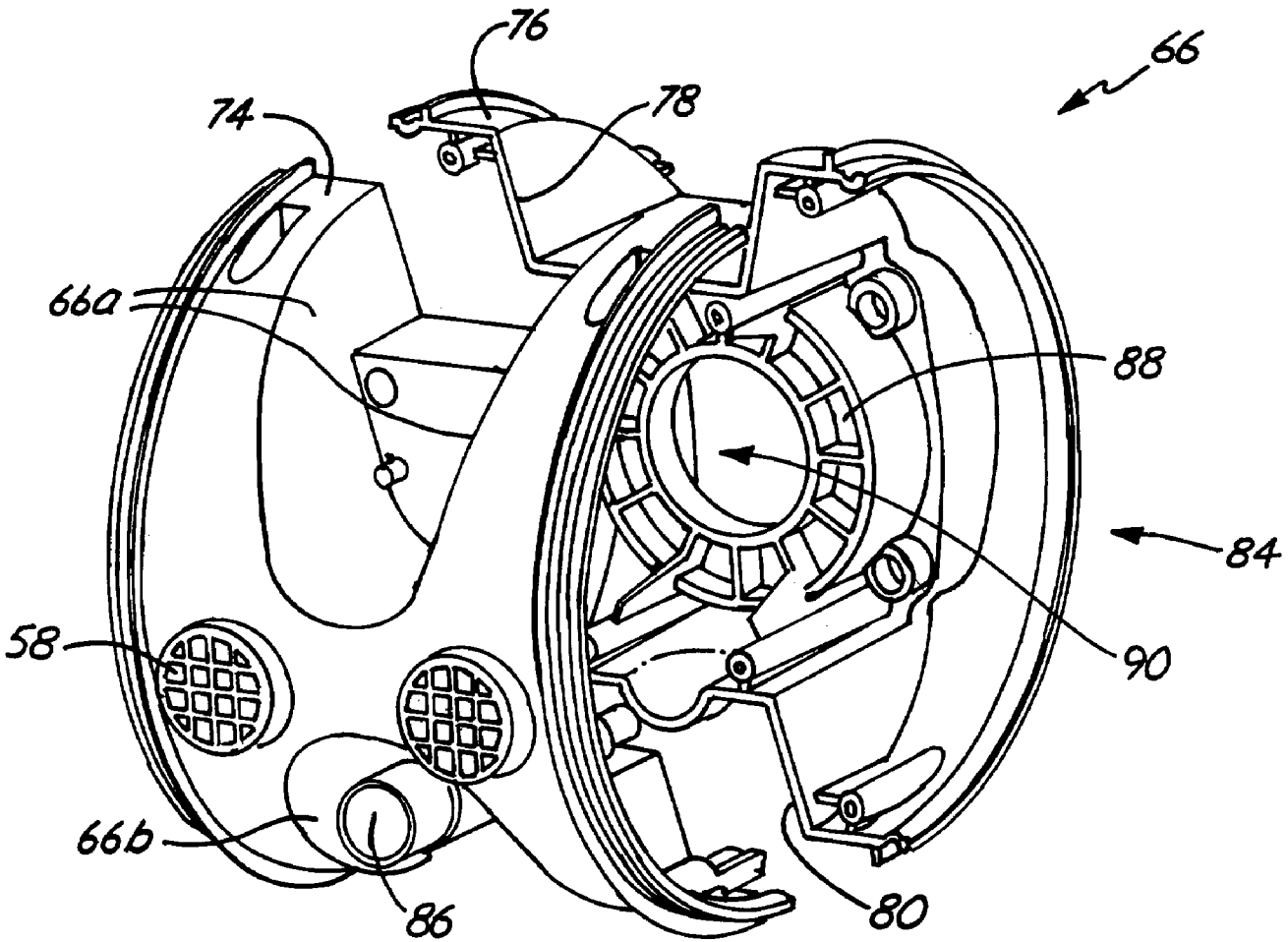
FIG. 13 is a perspective view of the air chamber shell.

FIG. 13 is a front view of air chamber shell 66. Air chamber shell 66, with curvilinear walls 66*a* and 66*b*, is comprised of first portion 74, second portion 76, top joint 78, bottom joint 80, first diaphragm opening 82 (not shown) and second diaphragm opening 84. First portion 74 further includes air ports 58 and blower inlet 86. Second portion 76 further includes motor mount 90 and motor opening 92.

First portion 74 and second portion 76 are secured together along top joint 78 and bottom joint 80 to form air chamber shell 66. Formation of air chamber shell 66 also defines first diaphragm opening 82 and second diaphragm opening 84 on either side of air chamber shell 66. First diaphragm assembly 68 and second diaphragm assembly 70 (FIG. 11) are positioned over first diaphragm opening 82 and second diaphragm opening 84, respectively, and are substantially parallel to each other.

Preferably, first portion 74 is comprised of plastic and second portion 76 is comprised of metal. The plastic reduces the weight of air pulse generator 16, while the metal dissipates heat from diaphragm motor 64 to prevent overheating.

Air ports 58 discharge air from the air chamber of air chamber assembly 56 and fluidly connect with air openings 30 of shell 18, such as by physically aligning with air openings 30 via seal 62. Blower inlet 86 fluidly connects with the discharge of blower 52, such as with a pipe or tube 54 (FIG. 11) to transfer air pressure to the air chamber.

Air chamber shell 66 has at least one of curvilinear walls 66*a* and 66*b*. Curvilinear walls 66*a* and 66*b* smooth the air flow movement between diaphragm openings 82 and 84. Curvilinear walls 66*a* and 66*b* have a substantially parabolic shape, but other curvilinear shapes, such as more circular curvilinear shapes, also smooth the air flow movement. The smoothed air flow movement reduces noise and vibration over prior art air pulse generators.

Within second portion 76, diaphragm motor 64 is mounted to motor mount 88. Diaphragm motor 64 fluidly seals motor opening 90 to further define the air chamber within air chamber assembly 56.

Figure 14:
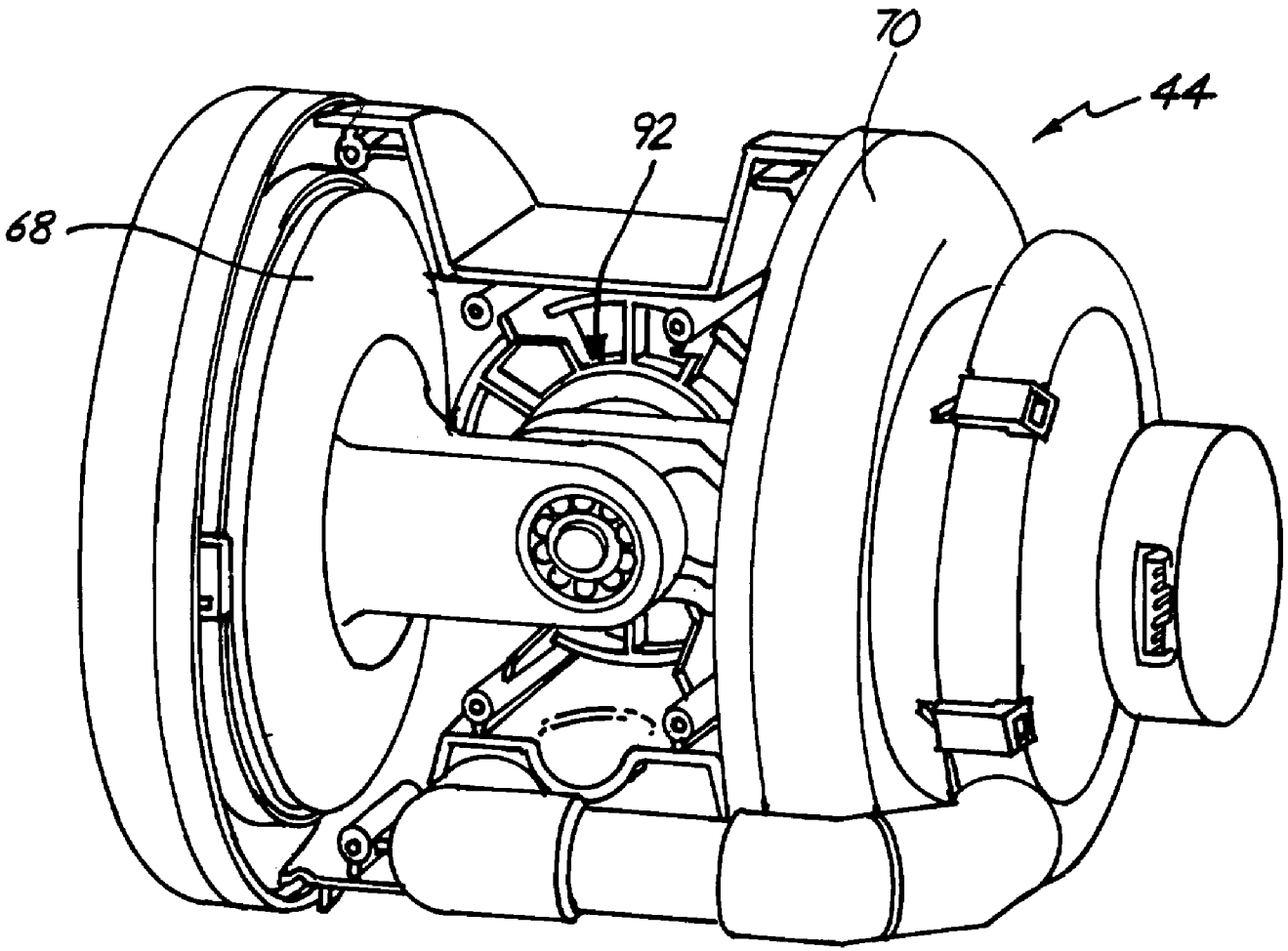
FIG. 14 is a perspective view of the crankshaft assembly within the air pulse module.

FIG. 14 shows the crankshaft assembly within air pulse module 44. Air pulse module 44 includes crankshaft assembly 92, first diaphragm assembly 68 and second diaphragm assembly 70. When in use, crankshaft assembly 92 operates, as described below in reference to FIG. 15, to move first diaphragm assembly 68 and second diaphragm assembly 70 in a manner that oscillates air within the air chamber.

Figure 15:
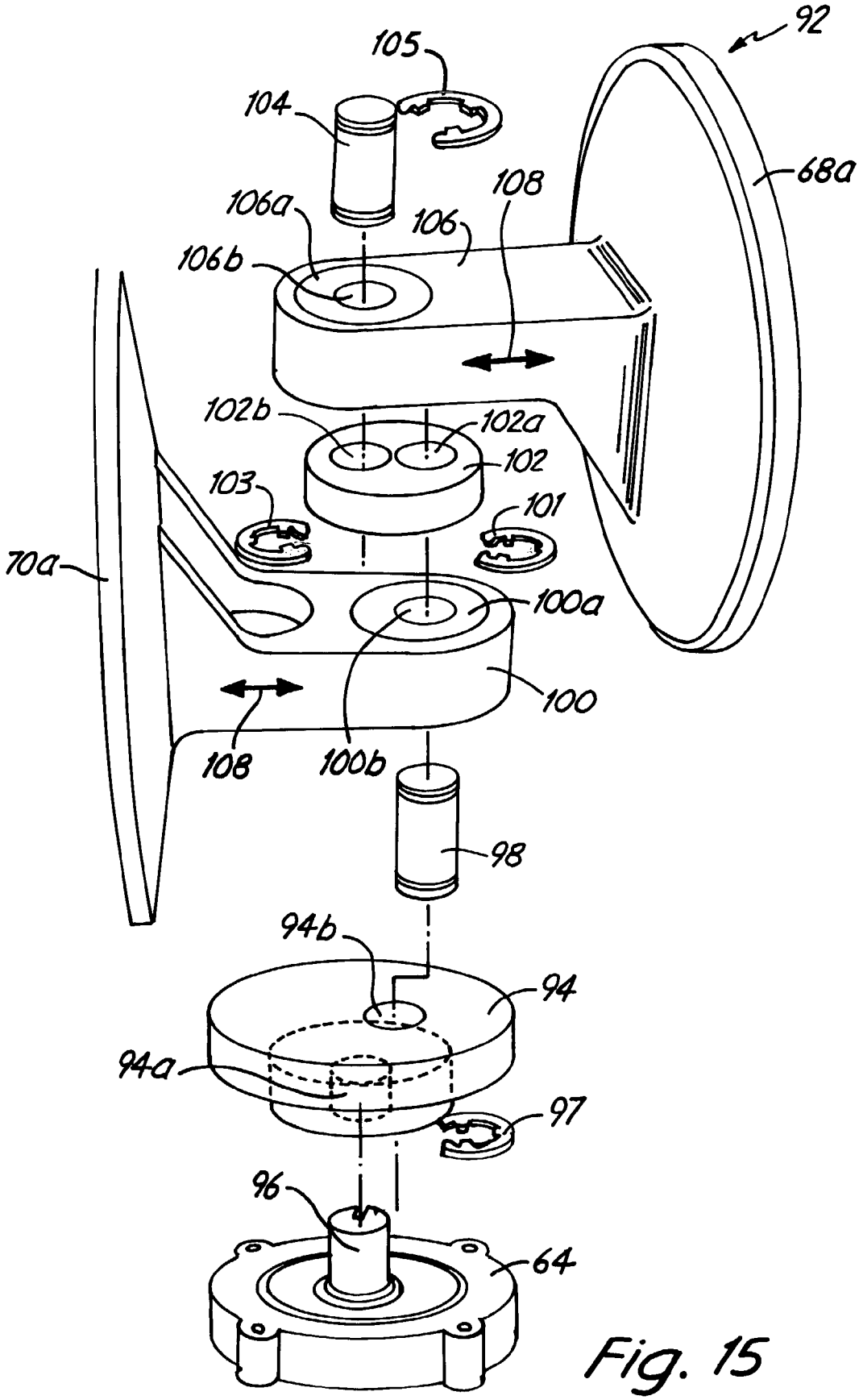
FIG. 15 is an exploded view of the crankshaft assembly.

FIG. 15 is an exploded view of crankshaft assembly 92. FIG. 15 shows crankshaft assembly 92, diaphragm motor 64 with drive shaft 96, air chamber shell 66, plates 68*a* and 70*a* and line of motion 108. Crankshaft assembly 92 further includes flywheel 94 having opening 94*a* centered on one face and opening 94*b* off-set on the opposite face, c-ring 97, stub shaft 98, member 100 having bearing 100*a* and opening 100*b*, c-ring 101, cam 102 having openings 102*a* and 102*b*, c-ring 103, member 106 having bearing 106*a* and opening 106*b*, stub shaft 104 and c-ring 105.

Drive shaft 96 is attached to diaphragm motor 64 at one end and attached at the other end to opening 94*a* of flywheel 94. Stub shaft 98 is attached to flywheel 94 at opening 94*b*. C-ring 97 secures stub shaft 98 within opening 94*b*. Bearing 100*a* is set within one end of member 100 allowing stub shaft 98 to pass through opening 100*b*. Bearing 100*a* allows stub shaft 98 to rotate within member 100. C-ring 101 secures stub shaft 98 within opening 100*b*. Stub shaft 98 is secured off-center through opening 102*a* of cam 102 by c-ring 101. Stub shaft 104 is secured off-center through opening 102*b* to the opposite face of cam 102 by c-ring 103 such that stub shafts 98 and 104 are positioned equally but oppositely spaced from the center of cam 102. Bearing 106*b* is set within one end of member 106 allowing stub shaft 104 to pass through opening 106*a*. Stub shaft 104 is secured to member 106 by c-ring 105 but is able to rotate within member 106. Member 100 is rigidly or integrally attached to plate 70*a* at an end opposite of bearing 100*a*, and member 106 is similarly rigidly or integrally attached to plate 68*a* at an end opposite of bearing 106*b*.

In operation, diaphragm motor 64 turns drive shaft 96 which, in turn, rotates flywheel 94 causing stub shaft 98 to rotate in a circular fashion. The rotary motion generated by stub shaft 98 is converted to a generally reciprocating motion, shown by line of motion 108, via member 100. The reciprocating motion of member 100 in turn reciprocates plate 70*a* generally along line of motion 108.

The rotary motion of stub shaft 98 is transferred to cam 102 causing cam 102 to rotate, and, in turn, stub shaft 104 rotates in an identical circular fashion. The rotary motion generated by stub shaft 104 is converted to a generally reciprocating motion, shown by line of motion 108, via member 106. The reciprocating motion of member 106 in turn reciprocates plate 68*a* generally along line of motion 108.

The generally reciprocating motion exhibited by members 100 and 106 is more precisely defined as elliptical motion. The elliptical motion is transferred to plates 68*a* and 70*a* such that plates 68*a* and 70*a* "wobble" relative to line of motion 108. When first diaphragm assembly 68 and second diaphragm assembly 70 are fully assembled, such as shown in FIG. 14, the flexible nature of diaphragm seals 68*b* and 70*b* allow plates 68*a* and 70*a* to tip inwardly and outwardly as they reciprocate in and out of diaphragm openings 82 and 84, respectively, relative to air chamber shell 66. In addition, crankshaft assembly 92 operates such that plates 68*a* and 70*a* reciprocate in opposite directions relative to each other. The reciprocating motion of plates 68*a* and 70*a* create the oscillatory air pressure component for delivering HFCWO to patient P.

Using a pair of reciprocating diaphragms or plates 68*a* and 70*a* helps to balance the vibration forces that are created by air pulse generator 16. The use of more than one diaphragm assembly would appear to add size and weight. However, adding a second diaphragm assembly in combination with improved motor control, as discussed above, results in a net weight savings. The reduction in vibration forces due to the balancing nature of opposed reciprocating diaphragm assemblies 68 and 70 allows for a reduced flywheel resulting in significant weight savings. Balanced motions allow for reduced peaks and variations in force which produce less noise and vibration and allow lighter and smaller mechanical components.

The air chamber defined by air chamber shell 66, first diaphragm assembly 68, second diaphragm assembly 70 and diaphragm motor 64 has a volume of about 130 in.$^3$ and an effective diaphragm area of about 56 in.$^2$. The effective diaphragm area is defined as the sum of the area of diaphragm openings 82 and 84. In comparison, THE VEST™ system has an effective diaphragm area of about 78 in.$^2$ and an air chamber volume of about 39 in.$^3$, and the Medpulse 2000™ system has an effective diaphragm area of about 144 in.$^2$ and an air chamber volume of about 182 in.$^3$.

The air chamber of air pulse generator 16 has a VA ratio of about 2.32. The VA ratio is defined as the air chamber volume divided by the effective diaphragm area. In comparison, THE VEST™ system has a VA ratio of about 0.5, and the Medpulse 2000™ system has a VA ratio of about 1.26.

Plates 68*a* and 70*a* reciprocate with a stroke length of about 0.5 in. In comparison, THE VEST™ system has a stroke length of about 0.375 in., and the Medpulse 2000™ system has a stroke length of about 0.312 in.

Figure 16:
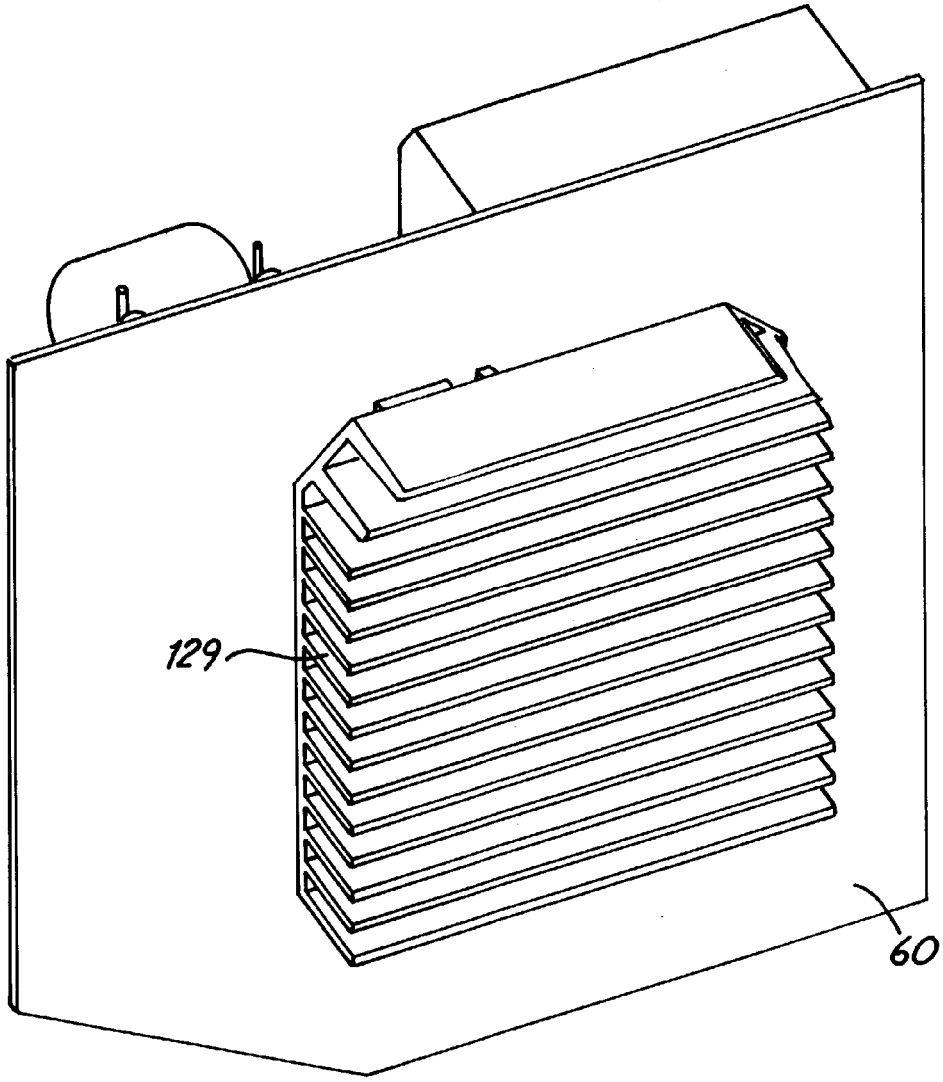
FIG. 16 is a perspective view of the heatsink on the control board.

FIG. 16 shows main control board 60 having heatsink 129. In the one embodiment, air pulse generator 16 includes heatsink 129 for dissipating internal heat from main control board 60. Heatsink 129 is made of metal and absorbs and dissipates heat from circuitry (FIG. 17) on the opposite side of main control board 60.

Alternatively, air from blower 52 may be diverted to cool main control board 60. However, the efficiency of blower 52 is compromised with this embodiment.

Figure 17:
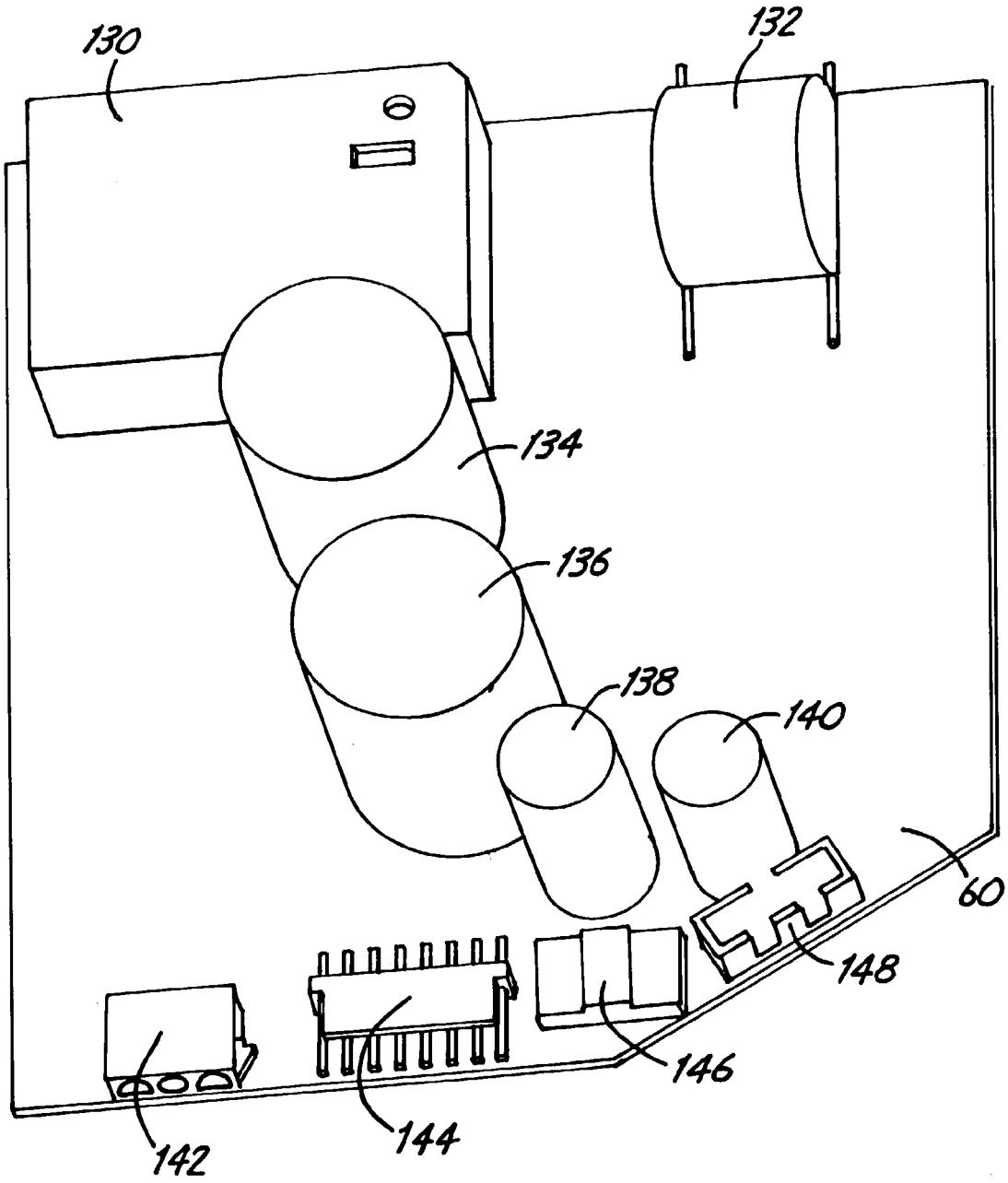
FIG. 17 is a perspective view of the electronic circuitry on the control board.

FIG. 17 shows the electronic circuitry of main control board 60 in more detail. Main control board 60 includes AC/DC Power module M1, Switching Power Supply inductor L1, Switching Power Supply capacitors C3 and C4, Diaphragm Output Voltage capacitor C13, Blower Output Voltage capacitor C14, AC Power input J1, Diaphragm Motor connector J3, Blower Motor connector J2 and User Interface connector J4.

The input power electrical system allows air pulse generator 16 to operate within specifications when the mains voltage is about 100–265 VAC, and the mains frequency is about 50 or 60 Hz+/−1 Hz. Air pulse generator 16 requires 3 Amps maximum. The rated running current is 2.5 Amps at 120 VAC or 1.25 Amps at 240 VAC. Typical idle current (plugged in but not running) is 30 mAmps at 120 VAC or 15 mAmps at 240 VAC. Ground Leakage current does not exceed 300 μAmps. The rated operating power is 300 watts, and the idle power is less than 4 watts.

The input power electrical system is designed to accommodate power irregularities as listed by UL 2601/EN 60601. In addition, it provides the required filtering for air pulse generator 16 to meet the requirements of EN 55011 (CISPR 11) Class B. The power inlet module provides filtering and fuse protection of both line and neutral, meeting the requirements of UL 2601/EN 60601. Connection to AC mains is supplied by a 6 ft. long minimum detachable power cord meeting the appropriate agency approvals including UL 2601/EN 60601. Power cords in the United States are "Hospital Grade" power cords.

The internal circuitry, described in more detail below, utilizes the mains AC input voltage and converts it to DC power for use by the various components. The internal power supply circuitry produces 5 VDC+/−3%, 12 VDC+/−3%, 18 VDC and 80 VDC. The 18 and 80 volt supplies are variable voltages (and, therefore, have no tolerance rating) that are microprocessor controlled to provide the correct blower and diaphragm motor speeds. The low voltage 5 and 12 volt supplies are for the display and control logic, microprocessor and related circuitry. The 5 and 12 volt supplies have a relatively small current requirement and are designed to be on when air pulse generator 16 is plugged in.

Switching Power Supply inductor L1 generates the required current to produce a of 6 VDC to 18 VDC for brushless blower motor 50. The maximum current draw is 4 Amps. This variable voltage is controlled by a feedback loop comprised of microprocessor based Switching Power Supply, motor voltage comparater, motor controller and Hall Effect motor sensor speed.

Switching Power Supply inductor L1 generates the required current to produce a voltage of 15 VDC to 80 VDC for diaphragm motor 64. The maximum current draw is 2 amps. This variable voltage is controlled by a feedback loop comprised of microprocessor based Switching Power Supply, motor voltage comparater, motor controller and Hall Effect motor sensor speed.

The backlight of display panel 110 requires 5 VDC at 500 mAmps. This circuitry is on only when air pulse generator 16 is plugged in and not in IDLE mode.

Air pulse generator 16 is controlled through user interface 28 using a combination of software and hardware. Patient P controls air pulse generator 16 via buttons 114–128 as described above. The status, settings and user messages are displayed on display panel 110.

Figure 18:
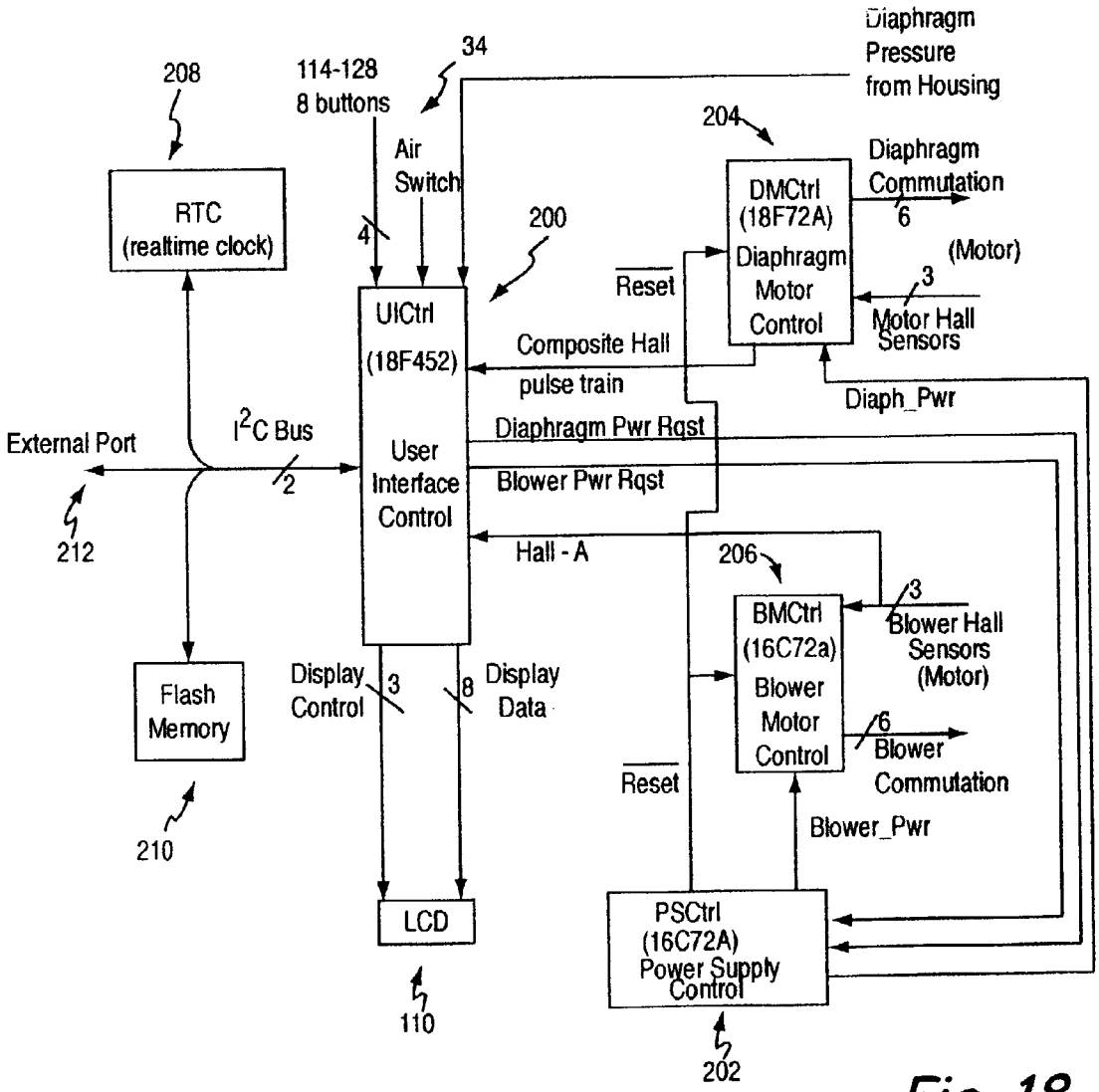
FIG. 18 is a block diagram of a control system of the present invention.

FIG. 18 is a block diagram showing a control system of air pulse generator 16. The control system includes User Interface control 200, Power Supply control 202, Diagram Motor control 204, Blower Motor control 206, Real Time clock 208, FLASH memory 210, and external port 212. User Interface control 200 monitors inputs from buttons 114–128 and from control switch 34 and provides outputs to control the operation of display panel 110 of user interface 28. In addition, User Interface control 200 coordinates the operation of Power Supply control 202, Diaphragm Motor control 204, and Blower Motor control 206.

User Interface control 200 provides a diaphragm power request signal and a blower power request signal to Power Supply control 202. The power request signals are analog signals which represent a desired motor drive voltage to be supplied to diaphragm motor 64 and blower motor 50, respectively.

User Interface control 200 receives a Hall-A signal from one Hall sensor of blower motor 50 and a composite Hall pulse train from Diaphragm Motor control 204. The Hall-A signal is used by User Interface control 200 to monitor the speed of blower motor 50. The composite Hall pulse train, which provides pulses for each signal transition of each of three Hall sensors of diaphragm motor 64 allows User Interface control 200 to monitor instantaneous speed of diaphragm motor 64. The composite Hall pulse train allows User Interface control 200 to monitor diaphragm instantaneous speed for every 12 degrees of rotation of diaphragm motor 64. Since diaphragm motor 64 is rotating at a relatively low speed (up to about 20 cycles per second maximum) and is subjected to uneven loads during each cycle, there is a need for monitoring instantaneous speed of diaphragm motor 64 closely in order to insure stable operation.

Based upon the desired operating parameters which have been set by patient P through buttons 114–128 and the sensed motor speeds provided by the composite Hall pulse train from Diaphragm Motor control 204 and the Hall-A sensor signal from blower motor 64, User Interface control 200 controls the rate of diaphragm power requests and the blower power requests supplied to Power Supply control 202. This can be accomplished by direct UIC 200 control or by the UIC 200 producing a reference voltage to the motor voltage comparater.

User Interface control 200 also receives a diaphragm pressure signal from a pressure sensor connected to the air chamber. The pressure signal is used as described above to derive a relationship between air chamber and vest pressure.

Power Supply control 202, Diaphragm Motor control 204, and Blower Motor control 206 are located on main control board 60 shown in FIG. 17. User Interface control 200, Real Time clock 208 and FLASH memory 210 are located on secondary control board 29 shown in FIG. 9.

Under normal operation, the software monitors requests from user interface 28 and control switch 34 and generates the appropriate electrical signals that operate air pulse generator 16 at the user specified parameters. In addition, the software maintains a timer to allow reporting of therapy session time and total usage time.

Control switch 34 is an input method to activate pulsing of air, alternatively ON switch 114 may be used to activate pulsing of air. The software provides user control to operate air pulse generator 16 in the various modes described above. Pausing during a therapy session to cough, remove mucus or take medication is controlled by the software via control switch 34. Lack of input by patient P while air pulse generator 16 is paused causes the software to begin IDLE mode.

The software also operates a timer that provides the user information about the current therapy session. The remaining session time is displayed on display panel 110. Session time consists of either both pulsing and paused time or just pause time, and the time is displayed in minutes (e.g. 17 Minutes To Go).

The software additionally operates another timer that provides cumulative operating hours. Compliance information is displayed on display panel 110 each time air pulse generator 16 is plugged in and in IDLE mode. Cumulative operating time includes both pulsing and paused time, and the time is displayed in hours and tenths of hours (e.g. Total Use 635.6 Hours).

An I/O data port is available for interfacing to air pulse generator 16 through user interface 28. The interface is an I/O data port serial protocol accessible via a special adapter designed to connect to the main board via a stereo jack style plug. All microprocessors are selected such that they have the I/O data port bus inherent in their design. The I/O data port bus master is the User Interface control (UIC) 200 and the slaves are the Power Supply control (PSC) 202, the Blower Motor control (BMC) 206 and the Diaphragm Motor control (DMC) 204. See FIG. 18.

The I/O data port allows the following functionality: A) user compliance information, specifically, a time and date stamp (cumulative operating time), is stored in memory for reading via user interface 28 or the I/O data port. Air pulse generator 16 contains memory capable of storing six months of cumulative operating time. Once the memory is full, storage of new information will overwrite the oldest data and maintain the most recent information.

B) Operating parameters are loaded in the microcontroller memory. Downloading the functional parameters (frequency, pressure and time) via this port is available to automate manufacturing final test and checkout.

C) Operational states and failures of air pulse generator 16 are transferred to user interface 28 or to the I/O data port for troubleshooting or customer feedback.

D) Software upgrades may be transferred to the microcontroller via the I/O data port.

The software is written in a Microchip PIC compatible version of the C programming language and may contain some assembly language. Executable code is generated by the HI-TECH C compiler specifically designed for the Microchip PIC controller family. The code is tested utilizing the MPLAB simulator from Microchip, a photo-type version of hardware, and a PIC-ICE (in-circuit emulator) from Phyton.

Air pulse generator 16 uses Microchip microcontrollers (or microprocessors) running with an oscillator speed of 8 MHz minimum to host the required software. These microcontrollers are selected based on the required functionality while allowing for future development. PSC 202, BMC 206, DMC 204 and UIC 200 are four microprocessor controllers used.

PSC 202 software delays startup for ⅓ second to allow charging of capacitors, receives requests from the DMC 204 and the BMC 206, controls the switching of the power supply capacitors and selects the appropriate switch for the output.

BMC 206 software controls commutation for blower motor 50, receives blower motor 50.

DMC 204 software controls commutation for diaphragm motor 64, and sense motor speed information such as the composite Hall pulse train to the UIC 200.

UIC 200 software manages display panel 110, reads button presses, times the session and stops air pulse generator 16 when finished, maintains cumulative operating time, sends pressure and frequency requests to the DMC 204 and BMC 206, writes parameters to FLASH memory 210 (using I/O data port), reads default parameter/messages from on board memory on the UIC 200 or from FLASH memory 210 (using I/O data port), reads messages/commands from an external port (using I/O data port), reads/writes Real Time Clock 208 (using I/O data port) and analyzes diaphragm pressure measurement.

External memory, such as FLASH memory 210 or on chip memory such as on UIC 200 stores patient use information, default parameter limits and display messages. All program instructions and variables are contained in the microcontroller on chip memory.

Figure 19:
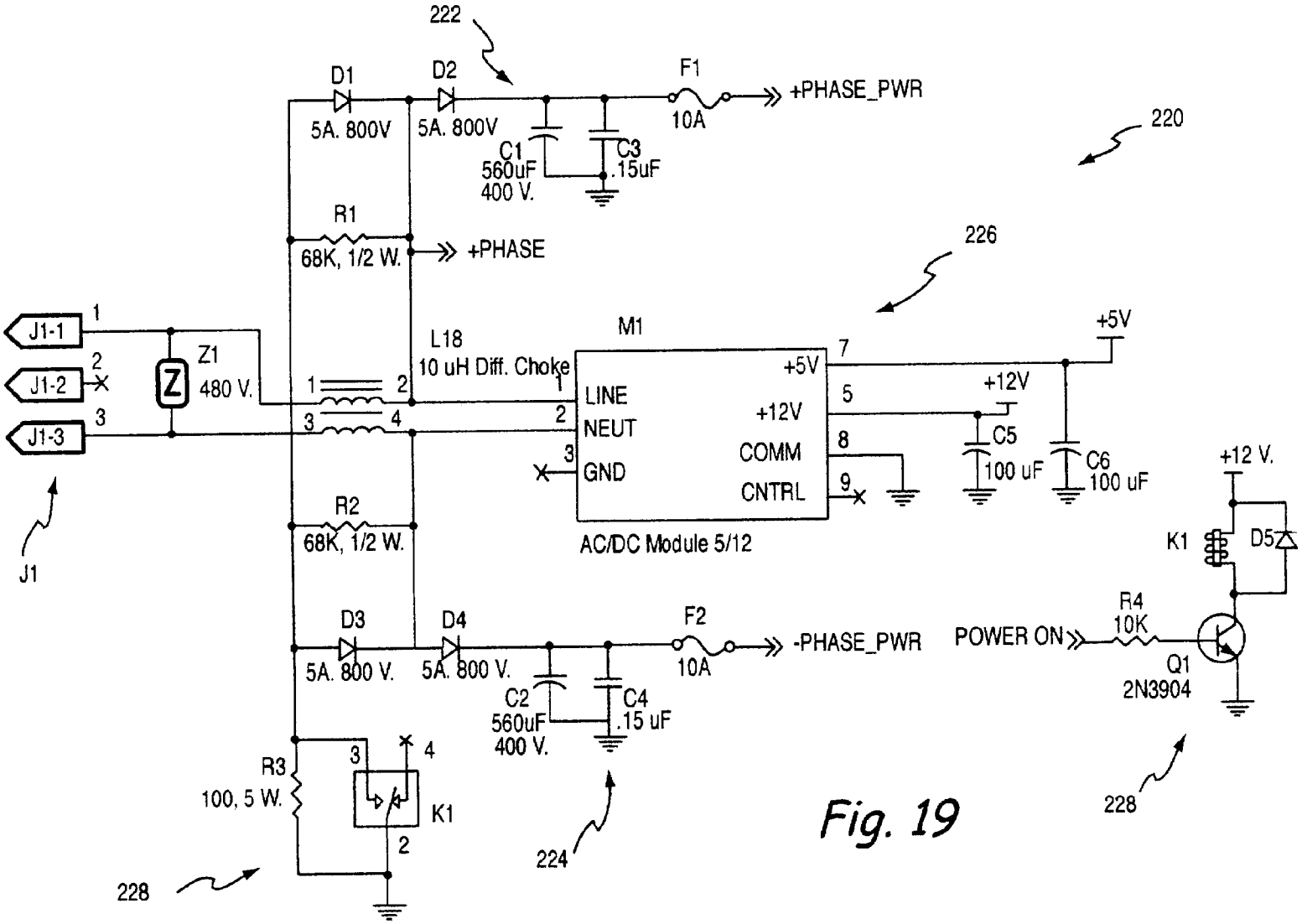
FIG. 19 is an electrical schematic diagram of the AC Mains circuit.

FIG. 19 is an electrical schematic diagram of AC Mains circuit 220, which is a portion of power supply control 202. AC Mains circuit includes AC Power Input connector J1 with terminals J1-1, J1-2 and J1-3, Positive Phase Power circuit 222, Negative Phase Power circuit 224, AC/DC Converter circuit 226 and Power On circuit 228.

AC Mains circuit 220 receives AC line power at connector J1 and supplies power to drive diaphragm motor 64 and blower motor 50 (+PHASE_PWR and −PHASE_PWR). In addition, AC Mains circuit 220 produces +5 V and +12 V signals which are used by the circuitry of the control system shown in FIG. 18.

Positive Phase Power circuit 222 includes resistor R1, diodes D1 and D2, capacitors C1 and C3, and fuse F1. Circuit 222 stores electrical power from the AC mains line power on capacitor C1. Approximately a 170 volt DC voltage is established at the +PHASE power output of circuit 222.

Similarly, circuit 224 produces the −PHASE power value based upon the other half cycle of AC power. Circuit 224 includes resistor R2, diodes D3 and D4, capacitors C2 and C4, and fuse F2. Circuit 224 stores electrical power from the AC mains line power on capacitor C2. A voltage of approximately 170 volts DC is established as the −PHASE power signal.

The +PHASE power and −PHASE power are supplied alternatively based upon the +PHASE signal which is derived from terminal J1-1 of connector J1. The +PHASE signal allows switching circuitry of Power Supply control 202 to alternately draw power from the +PHASE power and the −PHASE power in such a way that power is drawn from whichever capacitor is currently not being charged. This provides isolation between the AC line and the remaining circuitry of the control system, without the need for expensive and heavy line noise reduction circuitry.

The DC voltage levels used by the circuitry of the control system are produced by AC/DC circuit 226, which includes AC/DC module M1 and capacitors C5 and C6. Module M1 is a conventional AC to DC converter.

Also shown in FIG. 19 is Line Surge protector Z1. It is connected between terminals J1-1 and J1-3 of connector J1.

AC Mains circuit 220 also includes Power On circuit 228 which includes resistors R3 and R4, relay K1, transistor Q1, and diode D5.

Power On circuit 228 utilizes relay K1 in combination resistor R3 to provide a ⅓ second delay in startup. This allows capacitors C1 and C2 to precharge. Allowing ⅓ second for startup delay and 5 RC time constants for capacitors to fully charge, the resistance of resistor R3 is calculated as follows:

$$R=(0.33)/(5\times 560\ \mu F)$$

$$R=118\ \text{Ohms (use 100 Ohms)}$$

Choosing 100 Ohms limits $I_{rms}$ to 2.65 A (at $V_{rms}$=265 volts). 560 μF capacitors were sized for +/−PHASE power to stay above 100V with ripple at $I_{max}$ (which occurs at $V_{min}$). At 100 $VAC_{in}$, $VDC_{max}$=140 volts. If $VDC_{min}$=100 VDC, then $VDC_{avg}$=120 VDC. With 300 watts max power, $I_{C3/C4}$=300 watts/120 volts=2.5 amps. Each capacitor will be discharging for ½ an AC cycle (60 Hz) or 8.3 msec. The size of the capacitor required is calculated as follows: C=i(t)/V=(2.5)(0.0083)/40=519 μF (V=Vmax−Vmin=140−100=40). Diode D5 protects transistor Q1 from flyback current induced from relay K1.

Figure 20:
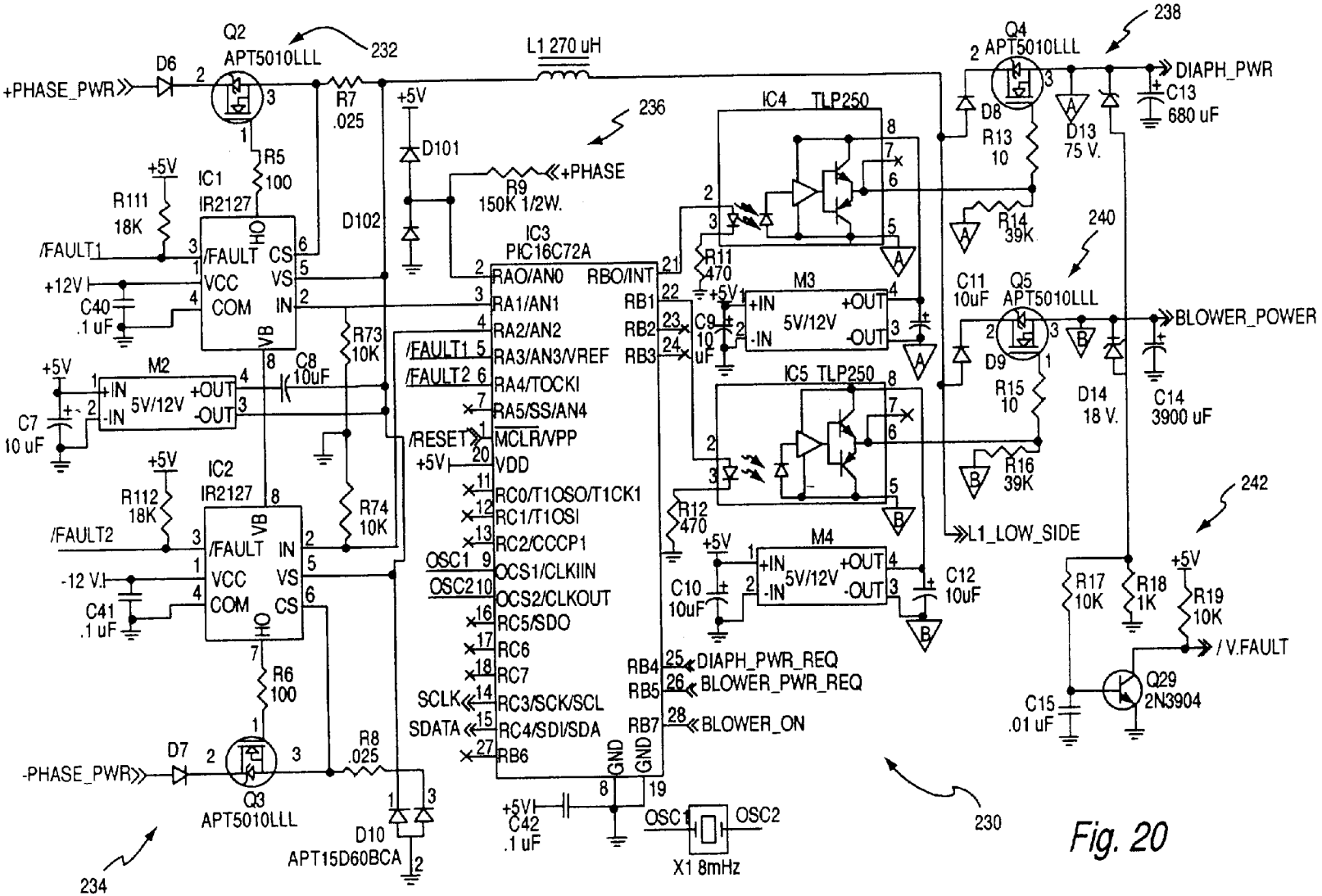
FIG. 20 is an electrical schematic diagram of the Switching Power Supply circuitry.

FIG. 20 shows Switching Power Supply circuitry 230, which uses the +PHASE power and −PHASE power received from AC Mains circuit 220 to produce variable voltages used to control the speed of diaphragm motor 64 and blower motor 50. Switching Power Supply circuitry 230 reduces electrical noise and allows several dynamically variable voltages to be produced by a single switching structure. The variable voltage used to control diaphragm motor 64 is labeled DIAPH_PWR, and the variable voltage used to control blower motor 50 is labeled BLOWER_PWR.

Switching Power Supply circuit 230 includes +PHASE Switching circuit 232, −PHASE Switching circuit 234, Switching Power Supply inductor L1, Phase Detection Input circuit 236, microprocessor IC8, Diaphragm Power Storage capacitor C13, Blower Power Storage capacitor C14, Diaphragm Power Charging circuit 238, Blower Power Charging circuit 240, Voltage Fault Sensing circuit 242, 5V/12V convertors M2, M3, and M4, and crystal oscillator X1.

Switching circuits 232 and 234 produce 10 Amp pulses which are supplied through inductor L1. When the +PHASE signal received by Phase Detection Input circuit 236 indicates that the −PHASE capacitors are being charged, circuit 232 supplies the 10 amp pulses. Conversely, when the +PHASE signal supplied from circuit 236 to the RAO input of microprocessor IC8 indicates that the +PHASE power storage capacitors are being charged, microprocessor IC8 activates circuit 234 to supply the current pulses using the −PHASE power. In this way, current is drawn from the +PHASE and −PHASE storage capacitors only during the times when they are not being charged.

+Phase Switching circuit 232 includes diode D6, transistor Q2, Current Sensing driver IC3, resistors R5 and R 111, capacitors C40 and C8 and Current Sensing resistor R7.

The +PHASE power is supplied through diode D6 to transistor Q2. IC3 is a high voltage, high speed power driver which supplies a control plus to a gate of Q2 to allow current from +PHASE power to flow through diode D6, transistor Q2 and Sensing resistor R7 to inductor L1. Microprocessor IC8 activates IC3 based upon the +PHASE sense signal by supplying an input signal to the input terminal IN of IC3. Q2 is turned on by IC3 for a time duration to produce a 10 amp pulse. IC3 senses the current through Sensing resistor R7 to control the current pulses.

−Phase Switching circuit 234 is similar to +Phase Switching circuit 232. It includes diode D7, transistor Q3, Current Sensing driver IC4, resistors R6 and R112, capacitor C41, and Current Sensing resistor R8.

When IC4 is turned on by microprocessor IC8, it switches transistor Q3 on and off to produce 10 amp pulses, which are sensed by IC4 using Sensing resistor R8. The 10 amp pulses are supplied through R8 to inductor L1.

Phase Detection Input circuit 236 includes resistors R9 and R10, capacitor C100 and diodes D101 and D102. The +PHASE signal is received from AC Mains circuit 220 and is supplied to the RAO input of microprocessor IC8.

Microprocessor IC8 controls the charging of capacitor C13 by Charging circuit 238 depending upon whether the diaphragm power request, DIAPH_PWR_REQ, signal at input RB4 is high or low. If the signal is high, circuit 238 is activated so that current pulses supplied through inductor L1 are used to charge capacitor C13.

Similarly, charging of capacitor C14 is controlled by microcontroller IC8 through Charging circuit 238 as a function of the BLOWER_PWR_REQ signal input at RB5. When circuit 240 is activated, current from inductor L1 is supplied to capacitor C14 to increase the BLOWER_PWR voltage.

Diaphragm Power Charging circuit 238 includes resistor R11, Optoisolator driver IC6, diode D8, resistors R13 and R14, and transistor Q4. When the output of IC8 at RBO goes high, IC6 is activated to turn on transistor Q4. That allows current pulses from L1 to pass through Q4 and charge Diaphragm Power Storage capacitor C13. As the pulses are received, the voltage on capacitor C13 will tend to increase. When the diaphragm power request signal supplied to IC8 goes low, circuit 238 turns off and charging of capacitor C13 ceases.

Blower Power Charging circuit 240 is similar to Diaphragm Power Charging circuit 238. It includes resistor R12, optoisolator driver IC7, diode D9, resistors R15 and R16, and transistor Q5. Microprocessor IC8 turns on IC7 and Q5 in response to the BLOWER_PWR_REQ signal being high. As long as that signal stays high, transistor Q5 is turned on and current pulses from L1 are used to charge capacitor C14.

Voltage Fault Sensing circuit 242 senses over voltage conditions on either capacitor C13 or C14. Voltage Fault Sensing circuit 242 includes zener diodes D13 and D14, resistors R17, R18, and R19, capacitor C15, and transistor Q29. The output of circuit 242 is a /V fault signal which is high as long as the voltage on C13 does not exceed the break down voltage of zener diode D13, or the lower power voltage on capacitor C14 does not exceed the break down voltage of zener diode D14.

Figure 21:
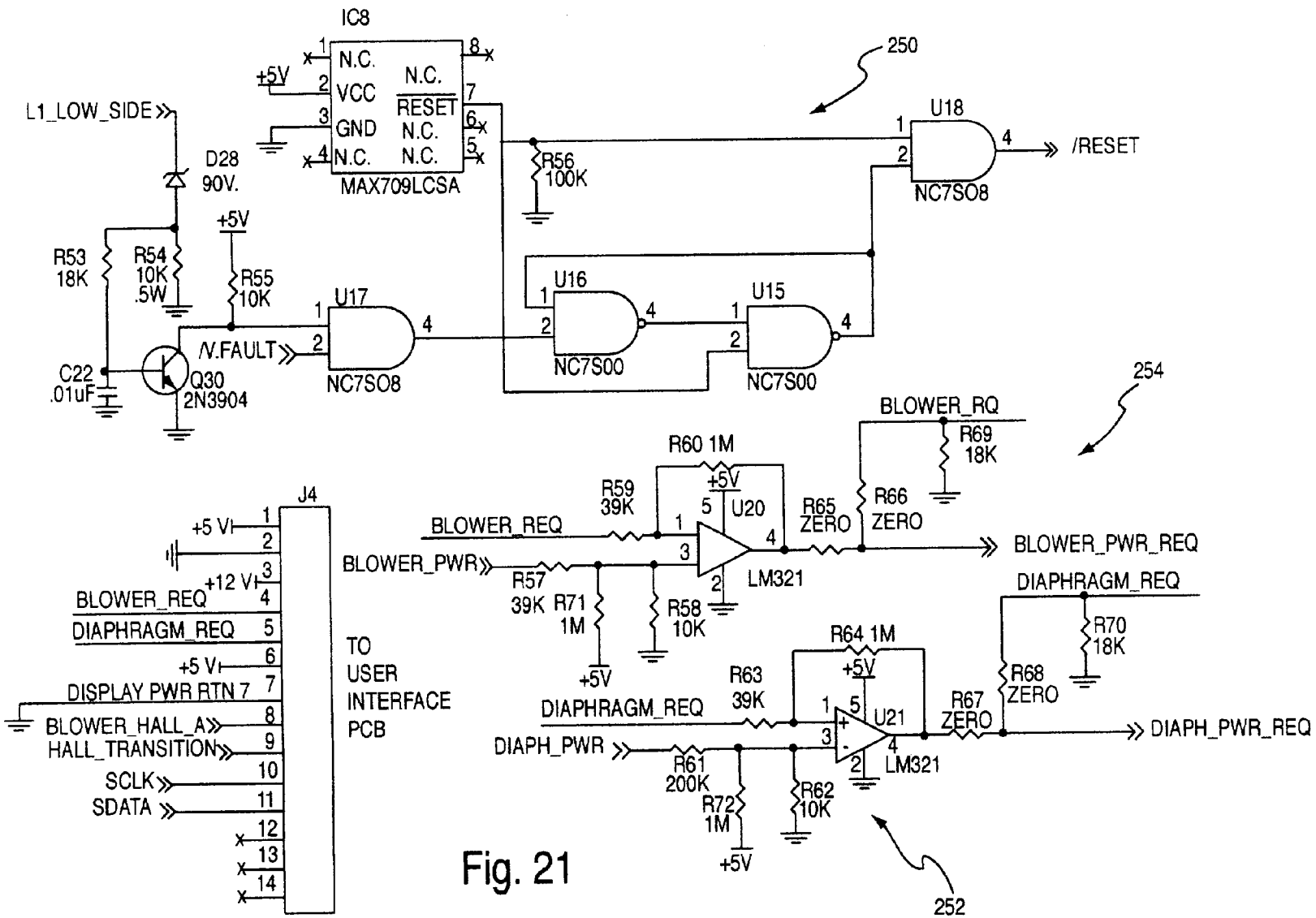
FIG. 21 is an electrical schematic diagram of the Power Up Clear & Fault Reset circuitry.

FIG. 21 shows additional components of the Power Supply control 202. Power Up Clear & Fault Reset circuit 250 provides a fault reset signal to microprocessor IC8 during power up conditions and in the event of a fault. Circuit 250 includes diode D28, resistors R53, R54, R55, and R56, capacitor C22, transistor Q30, and gates U15–U18 and power on Reset Pulse generator U19. The two fault conditions sensed by circuit 250 based upon the L1_LOW_SIDE signal drive from the low voltage side of inductor L1 (see FIG. 20) and the /V FAULT signal produced by circuit 242 of FIG. 20.

Also shown in FIG. 21 is connector J4, which provides electrical connections between User Interface control 200 and Power Supply control 202, Diaphragm Motor control 204 and Blower Motor control 206. User Interface control 200 is on a separate circuit board, such as secondary control board 29, from controls 202, 204, and 206, which may be located on main control board 60. FIG. 21 also shows Diaphragm Power Comparater circuit 252 and Blower Power Comparater circuit 254.

As shown in FIG. 21, circuit 252 includes resistors R61–R64, R67, and R68 and comparator U21.

Diaphragm Power Comparator circuit 252 produces the DIAPH_PWR_REQ input to microprocessor IC8 as a function of a DIAPHRAGM_PWR_REQ voltage supplied by User Interface control 200 through connector J4, and the DIAPH_PWR voltage stored on capacitor C13.

User Interface control 200 generates the DIAPHRAGM_PWR_REQ signal as a function of the desired oscillation frequency set by patient P (or automatically determined) and the sensed diaphragm motor speed based upon the composite Hall pulse train. The DIAPHRAGM_PWR_REQ signal is a speed command voltage which is compared to the stored voltage DIAP_PWR on capacitor C13. As long as DIAPH_PWR is less then the DIAPHRAGM_PWR_REQ level, the output DIAPH_PWR_REQ is high. As long as that signal is high, microprocessor IC8 turns Charging circuit 238 on to allow current pulses to be supplied to capacitor C13. When DIAPH_PWR exceeds the speed command signal DIAPHRAGM_PWR_REQ, the output of circuit 252 goes low, which causes microprocessor IC8 to turn off Charging circuit 238.

Blower Power Comparator circuit 254 is generally similar to Diaphragm Power comparator 252. It includes resistors R57–R60, R65, and R66 and comparator U20.

The speed command signal for blower motor 50 is BLOWER_REQ which is produced by User Interface control 200 as a function of the bias line pressure setting selected by patient P and the blower speeds as indicated by the Hall-A feed back signal from blower motor 50. That speed command signal is compared to the voltage on capacitor C14, BLOWER_PWR. As long as BLOWER_PWR is less than the BLOWER_REQ command, the output of circuit 242, BLOWER_PWR_REQ is high. That causes microprocessor ICS to turn on Charging circuit 240 to charge capacitor C14. When the command voltage BLOWER_REQ is reached or exceeded by BLOWER_PWR, the output of Comparator circuit 254 goes low, which causes microprocessor IC8 to turn off Charging circuit 240.

Figure 22:
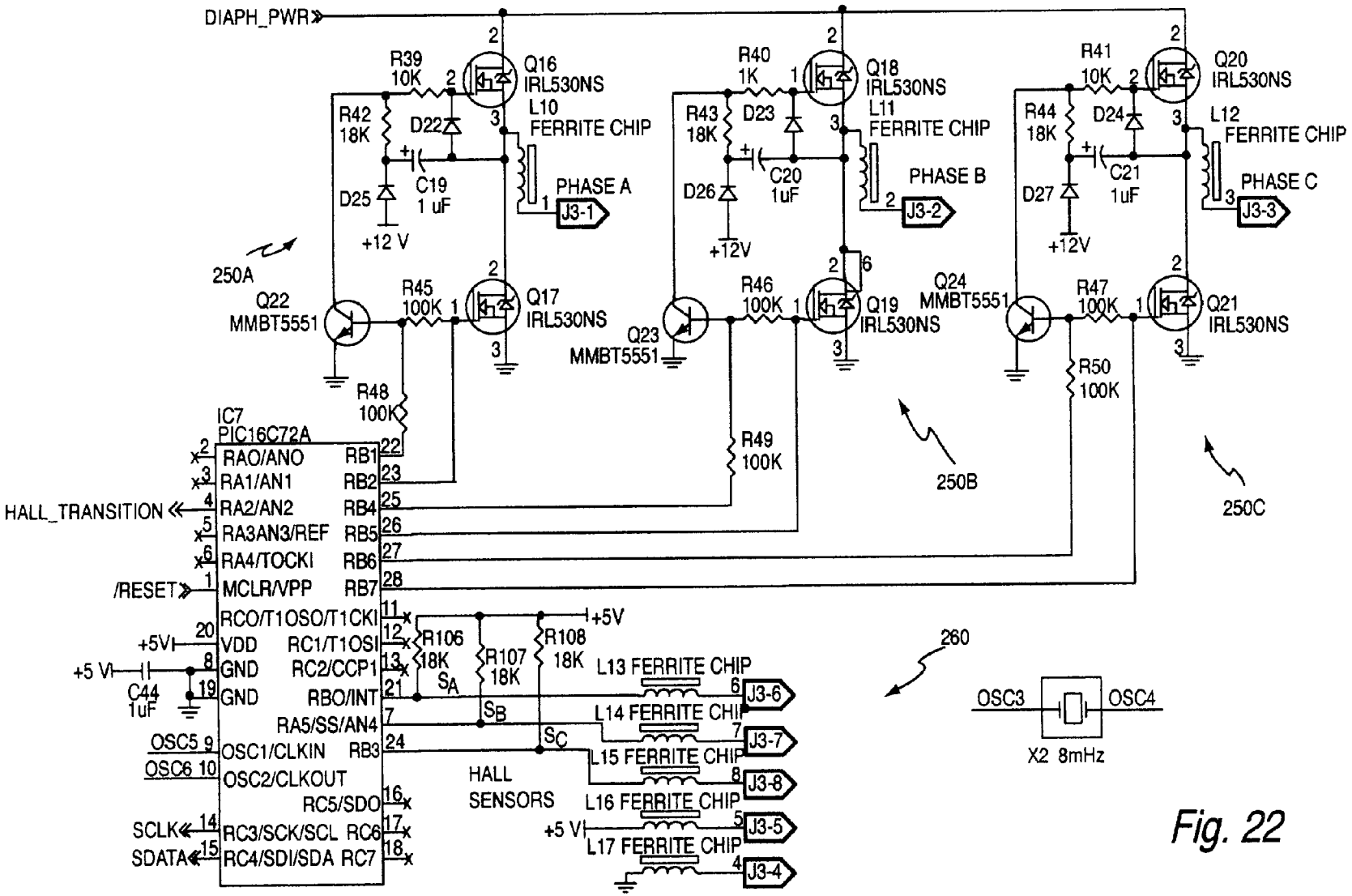
FIG. 22 is an electrical schematic diagram of the Diaphragm Motor controller.

FIG. 22 shows Diaphragm Motor control 204, which includes microprocessor IC10, crystal oscillator X3, connector J3 (which includes terminals J3-1 through J3-8), Phase A Drive circuit 250A, Phase B Drive circuit 250B, and Phase C Drive circuit 250C, and Hall Effect Sensor Interface circuit 260.

Diaphragm Motor control 204 receives the variable voltage DIAPH_PWR from Power Supply control 202. That variable voltage has supplied each of the three Phase Drive circuits 250A, 250B, 250C. Microprocessor IC10 acts as a sequencer or commutator to selectively turn on and off transistors of Drive circuits 250A, 250B, and 250C to cause rotation of diaphragm motor 64. The commutation is based upon on the Hall Effect sensor signals $S_A$, $S_B$ and $S_C$ which are received from the three Hall Effect sensors of the BC diaphragm motor. The Hall Effect sensor signals are supplied through terminals J3-6 through J3-8 to inputs of microprocessor IC10

In addition, microprocessor IC10 supplies the HALL_TRANSITION signal which is the composite Hall pulse train supplied to User Interface control 200, so that User Interface control 200 can determine the speed of diaphragm motor 64.

Drive circuit 250A is controlled by RB1 and RB2 outputs of microprocessor IC10. It includes resistors R39, R42, R45 and R48, diodes D22 and D25, capacitor C19, ferrite chip L10, transistor Q22, and Power Switching transistors Q16 and Q17.

Phase B Drive circuit 250B is controlled by RB4 and RB5 outputs of microprocessor IC10. It includes resistors R40, R43, R46, and R49, diodes D23 and D26, capacitor C20, ferrite chip L11, transistor Q23 and Power Switching transistors Q18 and Q19.

Similarly, Phase C Drive circuit 250C is controlled by RB6 and RB7 outputs of microprocessor IC10. It includes resistors R41, R44, R47, and R50, diodes D24 and D27, capacitor C21, ferrite chip L12, transistor Q24, and Power Switching transistors Q20 and Q21.

Hall Effect Sensor Interface circuit 260 includes ferrite chips L13–L17 and Pull Up resistors R106–R108.

Figure 23:
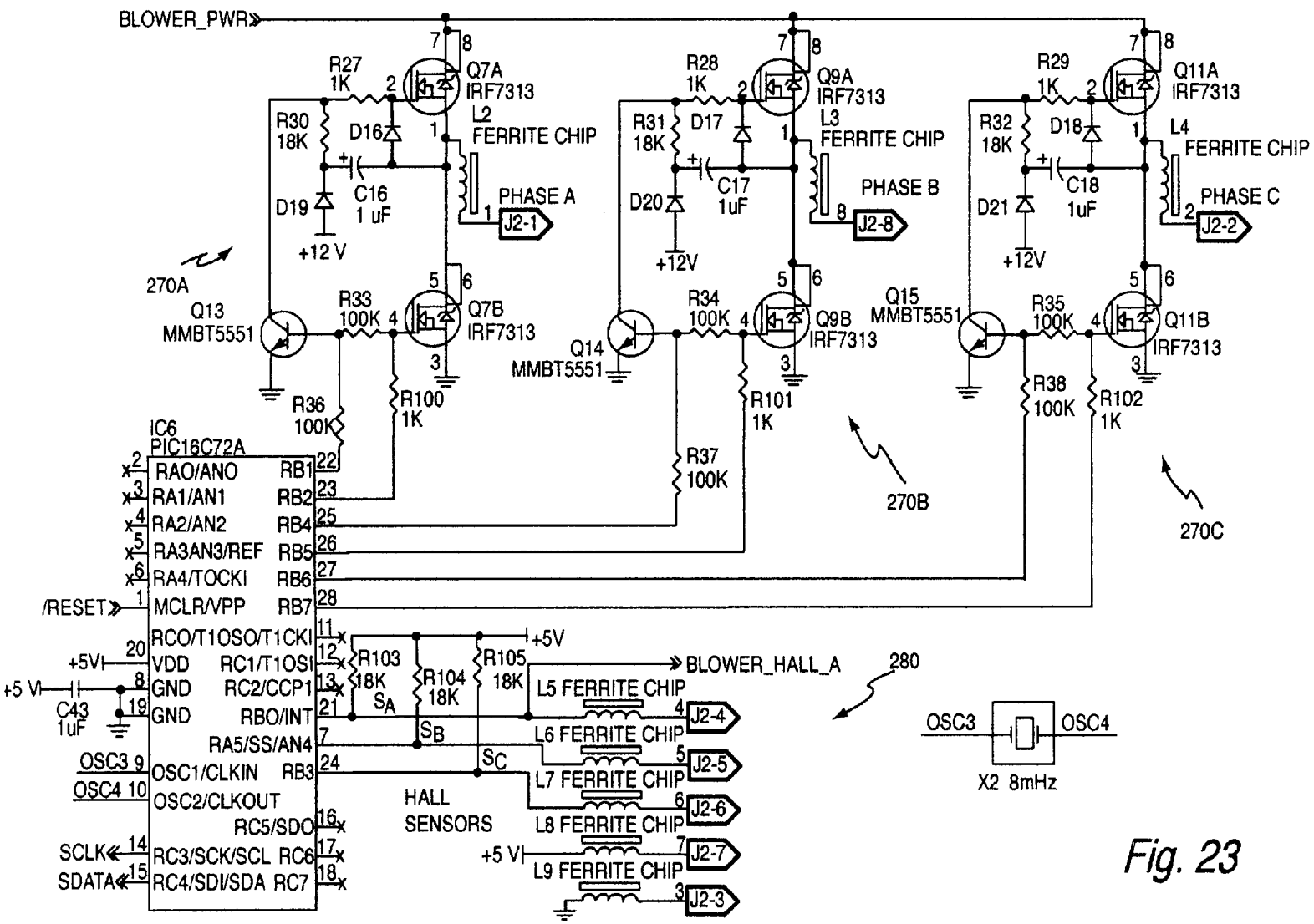
FIG. 23 is an electrical schematic diagram of the Blower Motor controller.

FIG. 23 is a schematic diagram of Blower Motor control 206. It includes microprocessor IC9, Phase A Drive circuit 270A, Phase B Drive circuit 270B, and Phase C Drive circuit 270C, and Hall Effect Sensor Interface circuit 280 and crystal oscillator X2.

Microprocessor IC9 controls Phase A, B, and C Drive circuits 270A–270C as a sequencer or commutator based upon the Hall Effect sensor signals $S_A$, $S_B$ and $S_C$. Drive circuits 270A–270C selectively supply the variable voltage BLOWER-PWR through the phase A, phase B, and phase C windings of blower motor 50. The operation of Blower Motor control 206 is similar to that of Diaphragm Motor control 204 with one exception. Because blower motor 50 runs at a much higher speed than diaphragm motor 64, a single Hall Effect sensor signal Blower_Hall_A can be supplied to User Interface control 202 as the speed feedback signal.

Drive circuit 270A is controlled by RB1 and RB2 outputs of microprocessor IC9. Drive circuit 270A includes resistors R27, R30, R33 and RR36, diodes D16 and D19, capacitor C16, ferrite chip L2, transistor Q13 and Power Switching resistors Q7A and Q7B.

Drive circuit 270B is controlled by RB4 and RB5 outputs of microprocessor IC9. Drive circuit 270B includes resistors R28, R31, R34 and R37, diodes D17 and D20, capacitor C17, ferrite chip L3, transistor Q14 and Power Switching transistors Q9A and Q9B.

Similarly, Phase C Drive circuit 270C is controlled by RB6 and RB7 outputs of microprocessor IC9. It includes resistors R29, R32, R35, and R38, diodes D18 and D21, capacitor C18, ferrite chip L4, transistor Q15, and Power Switching transistors Q11A and Q11B.

FIGS. 24–28 are graphs illustrating the performance of air pulse generator 16 with and without internal heat dissipation compared to prior art air pulse generators. A prior art air pulse generator, 103; air pulse generator 16 with air from blower 52 diverted to cool main control board 60, 104 cool; and air pulse generator 16 without diversion of air from blower 52, 104 were performance tested at 5 Hz, 10 Hz, 15 Hz and 20 Hz. The testing consists of measuring pressure inside a vest's air reserve (bladder) with a Vibration pressure transducer attached to the vest's connector port, and the output of the transducer is connected to an oscilloscope. A vest is connected to each of the air pulse generators and the observed pulse maximum (PMAX) and pulse minimum (PMIN) are recorded at each frequency, with the exception that 104 cool was not tested at 5 Hz. The delta, or pressure stroke, is calculated by subtracting the PMIN from PMAX.

Figure 24:
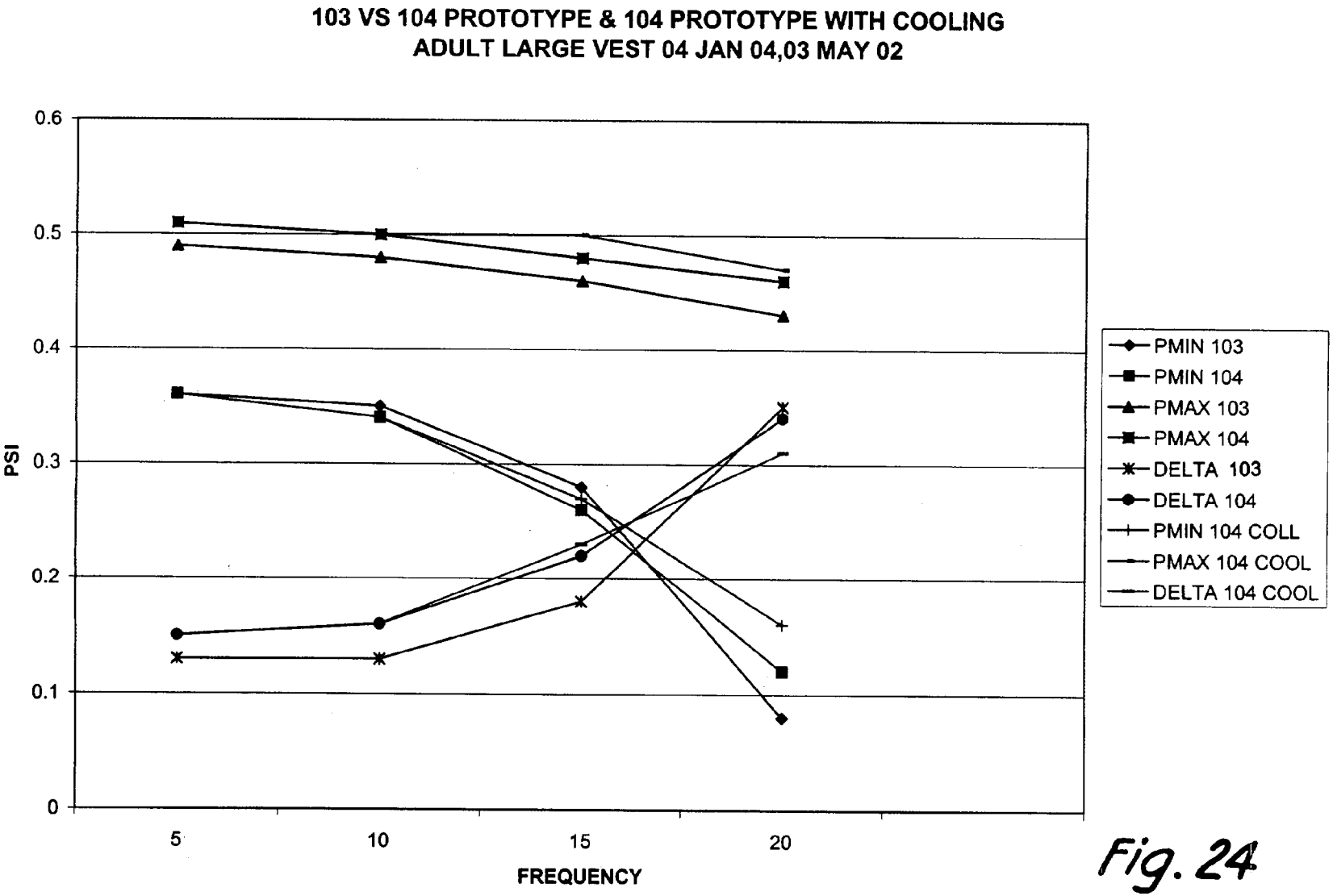
FIG. 24 is a graph illustrating the performance of the present invention using an adult large vest for HFCWO.
Figure 25:
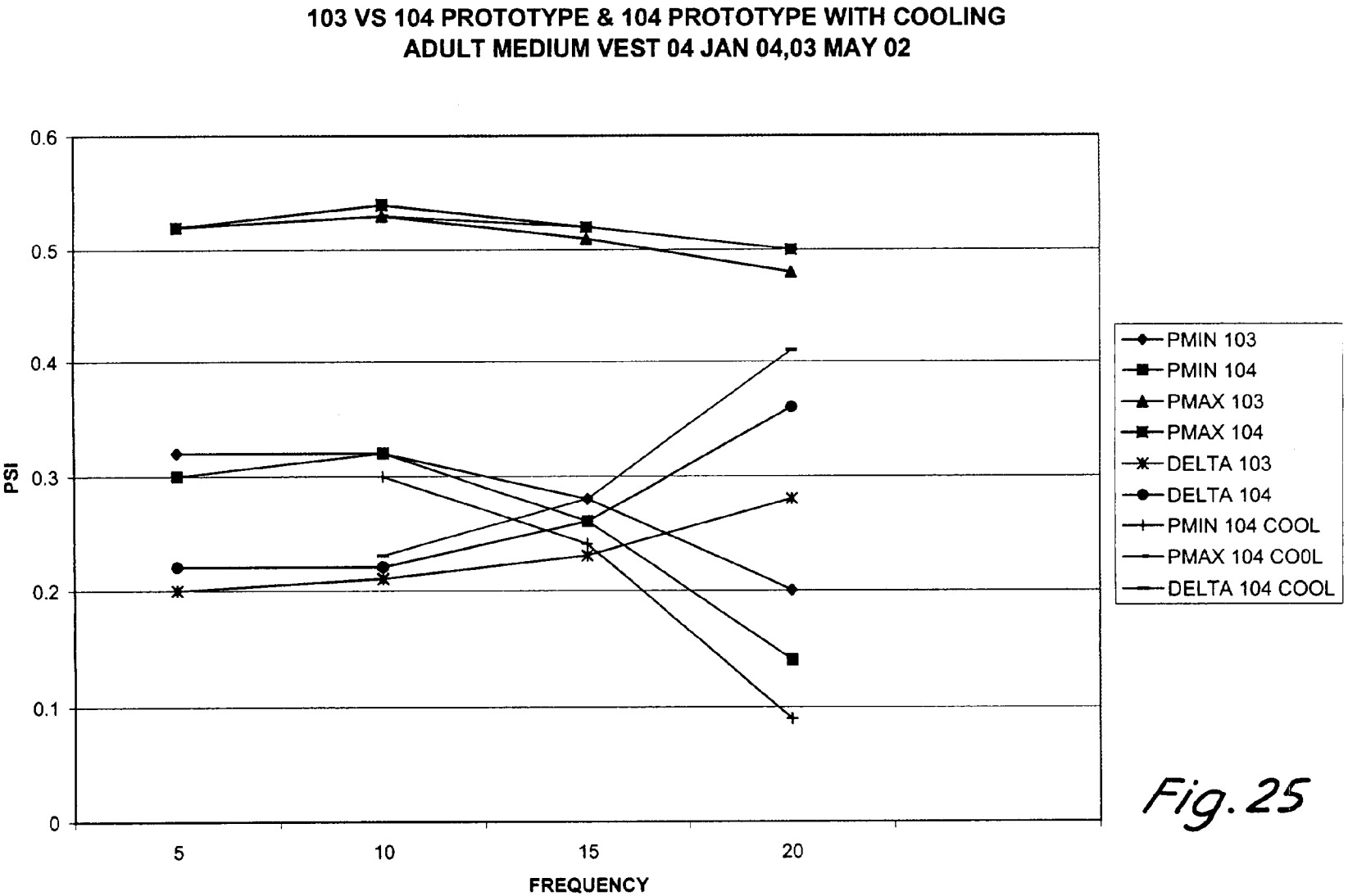
FIG. 25 is a graph illustrating the performance of the present invention using an adult medium vest for HFCWO.
Figure 26:
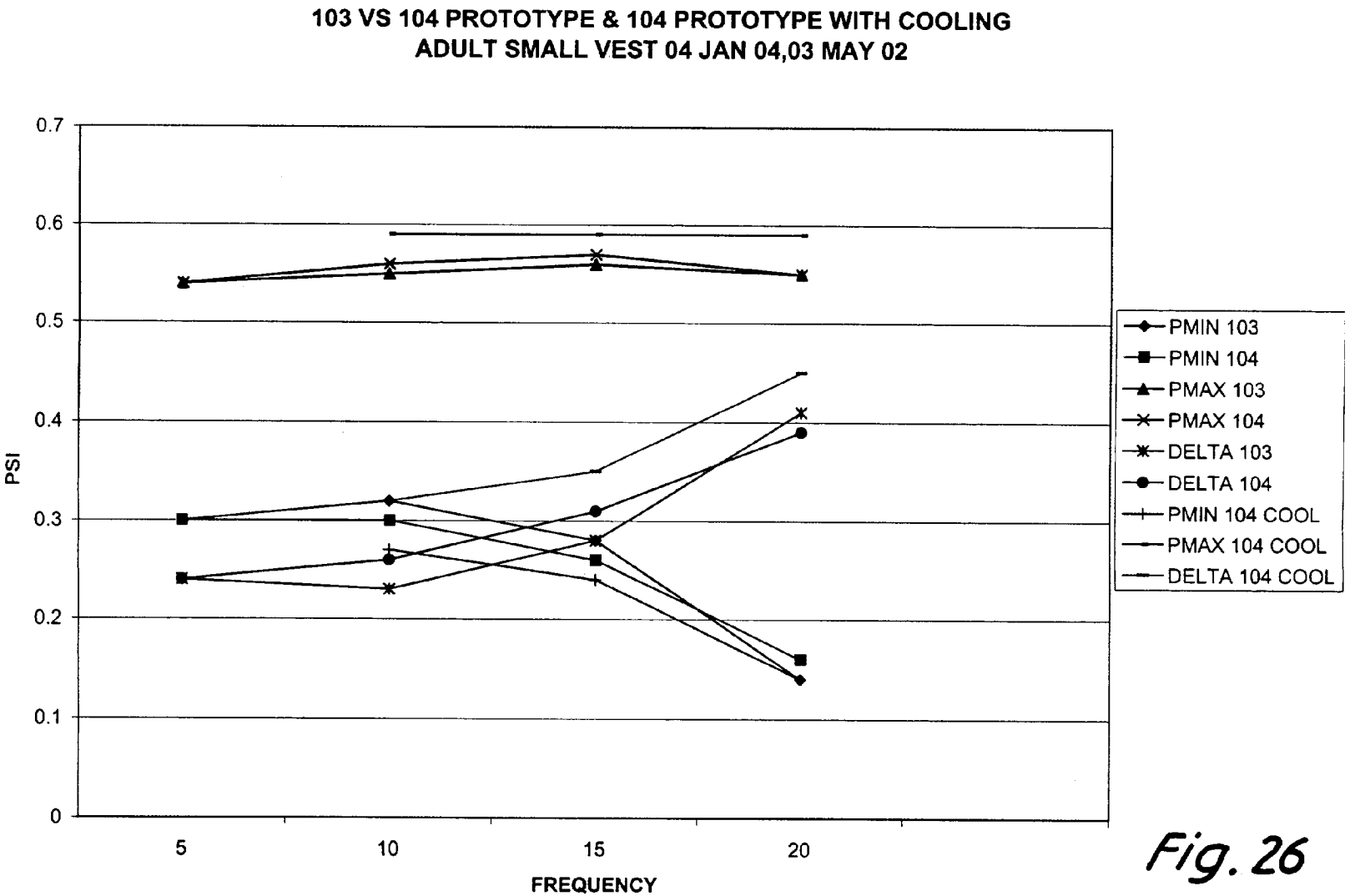
FIG. 26 is a graph illustrating the performance of the present invention using an adult small vest for HFCWO.
Figure 27:
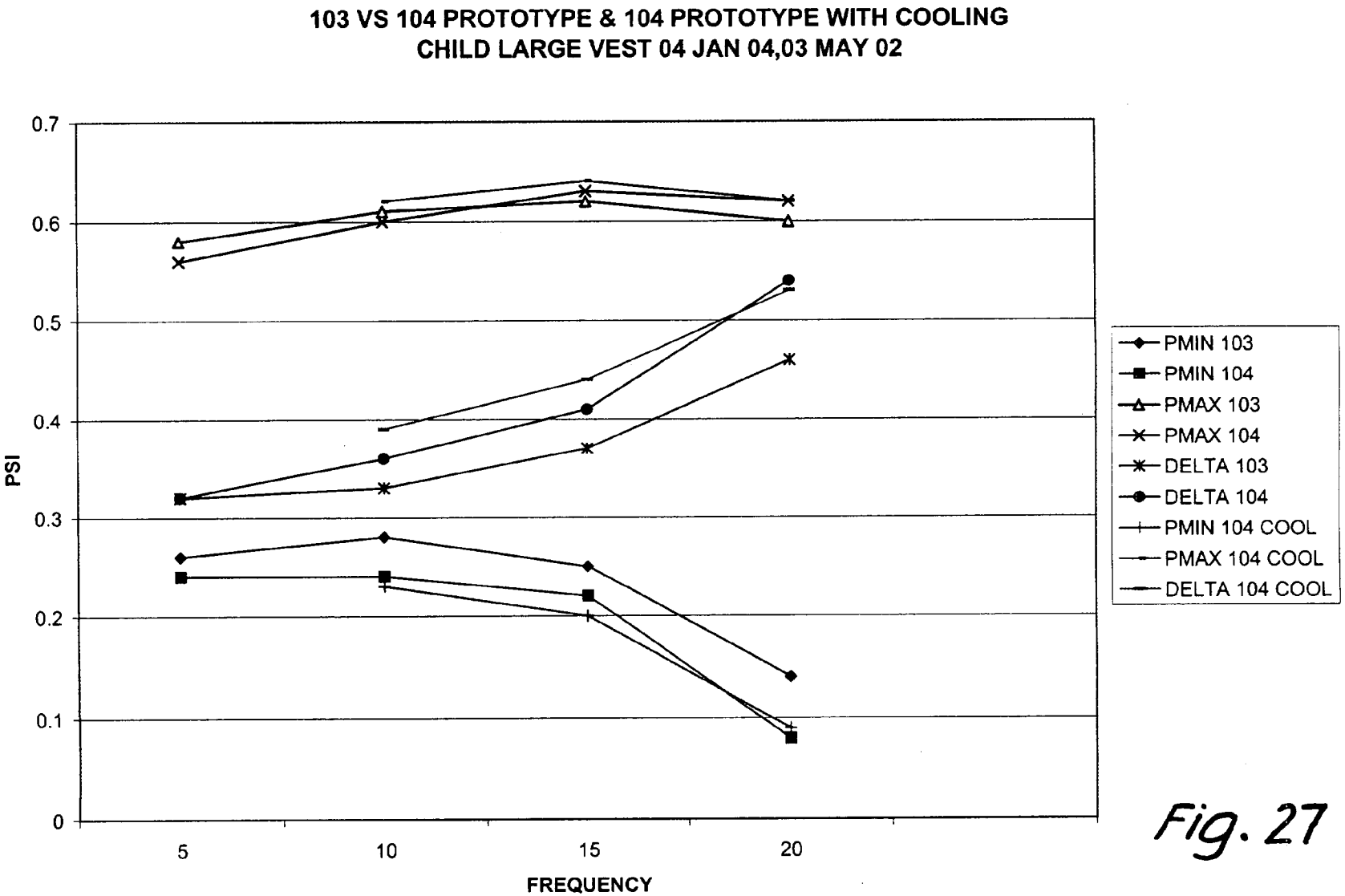
FIG. 27 is a graph illustrating the performance of the present invention using a child large vest for HFCWO.
Figure 28:
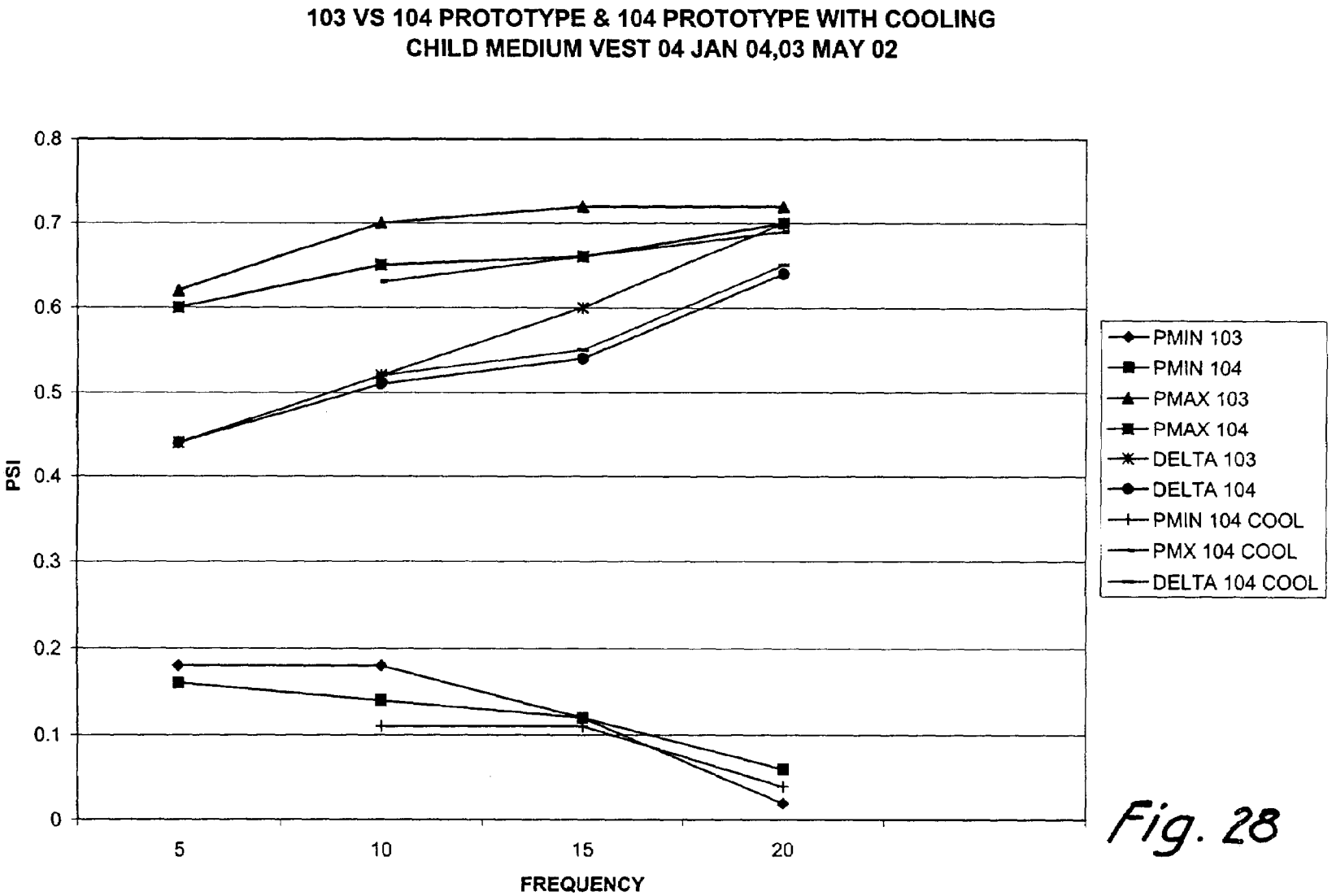
FIG. 28 is a graph illustrating the performance of the present invention using a child medium vest for HFCWO.

FIG. 24 shows the results using an adult large vest, FIG. 25 is the results using an adult medium vest, FIG. 26 is the results using an adult small vest, FIG. 27 is the results using a child large vest and FIG. 28 is the results using a child medium vest. As depicted in each of the graphs, 104 and 104 cool exhibit pressure consistent with the prior art air pulse generator.

Although the present invention has been described with reference to preferred embodiments, workers skilled in the art will recognize that changes may be made in form and detail without departing from the spirit and scope of the invention.

What is claimed is:

1. An air pulse generator-comprising:

a housing;

an air pulse module coupled to the housing, the air pulse module being configured to produce oscillating pressure in a plurality of operating modes;

a control coupled to the housing, the control being configured to control operation of the air pulse module, store programs for each mode that control the air pulse module to operate according to a corresponding protocol for each mode and respond to inputs for selecting modes; and a user interface coupled to the housing and usable to enter inputs to the control to select a mode such that the air pulse module operates according to the protocol corresponding to a selected mode, and a control switch including a connection plug and a control bulb, the housing including a port to removably receive the connection plug.

2. The air pulse generator of claim 1, wherein the control switch includes a tube connecting the connection plug to the control bulb.

3. The air pulse generator of claim 1, wherein the control switch acts as a toggle switch when the control bulb is depressed and released.

4. The air pulse generator of claim 1, wherein, in an on/off mode of the control switch, the control switch is perceived by the control as an on/off button, and activation of the control switch activates or deactivates the air pulse module.

5. The air pulse generator of claim 1, wherein, in a normally-off mode of the control switch, the control switch is perceived by the control as a normally-off switch, and constant activation of the control switch is required for continued operation of the air pulse module.

6. The air pulse generator of claim 1, wherein, in a pause mode of the control switch, the control switch is perceived by the control as a pause switch, and activation of the control switch suspends operation of the air pulse module.

7. An air pulse generator comprising:

a housing;

an air pulse module coupled to the housing, the air pulse module being configured to produce oscillating pressure in a plurality of operating modes;

a control coupled to the housing, the control being configured to control operation of the air pulse module, store programs for each mode that control the air pulse module to operate according to a corresponding protocol for each mode and respond to inputs for selecting modes; and a user interface coupled to the housing and usable to enter inputs to the control to select a mode such that the air pulse module operates according to the protocol corresponding to a selected mode, wherein the user interface allows a user to operate the air pulse module in a step run mode wherein the user interface allows a user to step the oscillation frequency over a range of frequencies while maintaining the same steady state pressure.

8. The air pulse generator of claim 7, wherein, in a high step range, the oscillation frequency is stepped through the following frequencies: 10 Hertz, 13 Hertz, 16 Hertz and 19 Hertz, wherein, in a normal step range, the oscillation frequency is stepped through the following frequencies: 8 Hertz, 11 Hertz, 14 Hertz and 17 Hertz, and wherein, in a low step range, the oscillation frequency is stepped through the following frequencies: 5 Hertz, 8 Hertz, 11 Hertz and 14 Hertz.

9. An air pulse generator for use with an inflatable garment configured to be positioned about a patient's torso for applying a high frequency chest wall oscillation therapy to the patient, the air pulse generator comprising:

a housing;

an air pulse module carried by the housing, the air pulse module being configured to produce oscillating pressure in a plurality of software-supported program modes and configured to produce oscillating pressure in a software-supported manual mode, the plurality of program modes including a step run mode;

a control carried by the housing, the control being configured to control operation of the air pulse module, store software for each mode that control the air pulse module to operate according to a corresponding protocol for each mode and respond to inputs for selecting modes; and a user interface carried by the housing, wherein the user interface includes a display to show status of the air pulse module and a plurality of buttons usable to enter inputs to the control to select one of the program modes or select the manual mode, wherein, when a user selects one of the program modes, the air pulse module operates according to the protocol corresponding to a selected program mode, and wherein, when the user selects the manual mode, the user interface allows the user to select an oscillation frequency, a pressure and a session time.

10. The air pulse generator of claim 9, wherein the oscillation frequency can be set to a first value ranging from about 5 Hertz to about 25 Hertz, the pressure can be set to a second value ranging from about 0 inches of water to about 10 inches of water, and the session time can be set to a third value ranging from about 0 minutes to about 99 minutes.

11. The air pulse generator of claim 9, wherein the plurality of program modes include a sweep mode.

12. The air pulse generator of claim 9, wherein the function of at least some of the plurality of buttons depends on the selected mode of the air pulse generator.

13. The air pulse generator of claim 9, wherein the air pulse module produces a composite pressure having a steady state pressure component and an oscillating pressure component, and the steady state pressure is greater than atmospheric pressure so that the composite pressure is above atmospheric pressure during operation of the air pulse module.

14. The air pulse generator of claim 13, wherein the oscillating pressure component has at least one frequency between about 5 Hertz and about 25 Hertz.

15. An air pulse generator for use with an inflatable garment configured to be positioned about a patient's torso for applying a high frequency chest wall oscillation therapy to the patient, the air pulse generator comprising:

a housing;

an air pulse module carried by the housing, the air pulse module being operable to produce oscillating pressure in a plurality of software-supported operating modes, the plurality of operating modes including a sweep run mode and a step run mode;

a control carried by the housing, the control being configured to control operation of the air pulse module, store software for each mode that control the air pulse module to operate according to a corresponding protocol for each mode and respond to inputs for selecting modes; and a user interface carried by the housing, wherein the user interface includes a display to show status of the air pulse module and a plurality of buttons usable to select a mode such that the air pulse module operates according to the protocol corresponding to a selected mode.

16. The air pulse generator of claim 15, wherein, in a high sweep range, the oscillation frequency is swept between about 10 Hertz to about 20 Hertz, wherein, in a normal sweep range, the oscillation frequency is swept between about 7 Hertz to about 17 Hertz, and wherein, in a low sweep range, the oscillation frequency is swept between about 5 Hertz to about 15 Hertz.

* * * * *